US007146124B2

(12) United States Patent
Okamoto et al.

(10) Patent No.: US 7,146,124 B2
(45) Date of Patent: Dec. 5, 2006

(54) DEVELOPER CARTRIDGE, DEVELOPING APPARATUS USING THE SAME, AND IMAGE FORMING APPARATUS

(75) Inventors: Masaya Okamoto, Iwatsuki (JP); Masamichi Kimura, Iwatsuki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 203 days.

(21) Appl. No.: 10/841,550

(22) Filed: May 10, 2004

(65) Prior Publication Data

US 2005/0123322 A1 Jun. 9, 2005

(30) Foreign Application Priority Data

Dec. 3, 2003 (JP) ..... 2003-405040

(51) Int. Cl.
*G03G 15/01* (2006.01)

(52) U.S. Cl. ..... 399/227

(58) Field of Classification Search ..... 399/262, 399/120, 119, 107, 227
See application file for complete search history.

(56) References Cited

U.S. PATENT DOCUMENTS

| | | | | |
|---|---|---|---|---|
| 5,381,217 | A * | 1/1995 | Ishida | 399/120 |
| 5,761,586 | A * | 6/1998 | Kawashima et al. | 399/262 |
| 5,794,108 | A * | 8/1998 | Yoshizawa et al. | 399/262 |
| 6,072,969 | A * | 6/2000 | Yokomori et al. | 399/119 |
| 6,104,898 | A * | 8/2000 | Awano et al. | 399/119 |
| 6,192,211 | B1 * | 2/2001 | Kimura | 399/227 |
| 6,295,429 | B1 * | 9/2001 | Isobe et al. | 399/227 |
| 6,301,460 | B1 * | 10/2001 | Elliott | 399/262 |
| 6,546,220 | B1 * | 4/2003 | Asakura et al. | 399/227 |
| 6,597,881 | B1 * | 7/2003 | Hatori et al. | 399/227 |
| 6,934,490 | B1 * | 8/2005 | Koyama et al. | 399/120 |
| 6,996,359 | B1 * | 2/2006 | Awaya | 399/227 |
| 2003/0137675 | A1 | 7/2003 | Minagawa | |

FOREIGN PATENT DOCUMENTS

| | | |
|---|---|---|
| JP | A 10-198145 | 7/1998 |
| JP | A 11-149211 | 6/1999 |
| JP | A 2000-162861 | 6/2000 |
| JP | 2003-316138 A | 6/2003 |
| KR | 2003-063105 A | 7/2003 |

* cited by examiner

*Primary Examiner*—Susan Lee
(74) *Attorney, Agent, or Firm*—Oliff & Berridge, PLC

(57) ABSTRACT

Provided are a developer cartridge and a developing apparatus using the developer cartridge, the developer cartridge making it possible to set the amount of developers that can be received to be large even when used in a miniaturized developing device and simplify the mechanism for opening/closing a supply outlet of the developer cartridge. As a result, the developer cartridge has no wasted space and thus can be miniaturized. In order to attain the above, the present invention provides a developer cartridge including a developer receiving portion that receives a new developer and has a section formed to have a shape that occupies a substantially entire space that is allocated to the developer cartridge to be attached.

29 Claims, 18 Drawing Sheets

(A)

(B)

DEVELOPER CARTRIDGE, DEVELOPING APPARATUS USING THE SAME, AND IMAGE FORMING APPARATUS

FIELD OF THE INVENTION AND RELATED ART STATEMENT

The present invention relates to a developer cartridge, a developing apparatus using the developer cartridge, and an image forming apparatus, the developer cartridge being used for an image forming apparatus to which an electrophotographic process is applied, such as a full-color copying machine, a printer, a facsimile machine, or a multifunction device thereof. In particular, the present invention relates to a developer cartridge, a developing apparatus using the developer cartridge, and an image forming apparatus, the developer cartridge being capable of receiving a sufficient amount of developers even when used in a miniaturized developing apparatus.

Up to now, as an example of the image forming apparatus to which an electrophotographic process is applied, such as a full-color copying machine, a printer, a facsimile machine, or a multifunction device thereof, there is an image forming apparatus of a so-called tandem system structured so as to form a full-color image by the following procedure. That is, plural image forming portions corresponding respectively to yellow, magenta, cyan, black, etc. are arranged side by side, and toner images in respective colors of yellow, magenta, cyan, black, etc. which have been formed in the corresponding image forming portions are directly transferred onto a recording sheet or subjected to a secondary transfer onto a recording sheet through an intermediate transfer belt or the like.

As an example of the image forming apparatus such as a full-color copying machine and a printer, there is an image forming apparatus of a so-called "four-cycle" system structured so as to form a full-color image by the following procedure. That is, plural developing devices corresponding respectively to yellow, magenta, cyan, black, etc. are arranged in a position adjacent to a single photosensitive drum along the circumferential direction of a developing apparatus main body. The developing apparatus main body is driven to rotate to move in turn the developing devices corresponding to the respective colors to a developing position opposed to the photosensitive drum. With a predetermined number of revolutions of the photosensitive drum, toner images in respective colors of yellow, magenta, cyan, black, etc. are respectively formed on the photosensitive drum. Then, the toner images in respective colors of yellow, magenta, cyan, black, etc. which have been formed on the photosensitive drum are directly transferred onto a recording sheet or subjected to a secondary transfer onto a recording sheet through an intermediate transfer belt or the like.

In comparison between the image forming apparatuses of the tandem system and the four-cycle system, the image forming apparatus of the four-cycle system has an advantage in that only one photosensitive drum is required, thus allowing miniaturization.

Examples of a developer cartridge used for the image forming apparatus of the four-cycle system are already disclosed in JP 10-198145 A, JP 11-149211 A, and JP 2000-162861 A.

The image forming apparatus according to JP 10-198145 A includes: a developer cartridge that receives developer components containing at least one of toner and a carrier and is provided with a supply outlet for supplying the developer components to the outside; a developing device to which the developer cartridge is detachably attached and which has an opening as an inlet for the developer components in a position opposed to the supply inlet of the developer cartridge that is attached correctly; and a slide shutter that is slid on the surface of the developing device so as to open and close the inlet in conjunction with the operation of attaching/detaching the developer cartridge. In the above image forming apparatus which forms an image by opposing the developing device to a rotational drum, the slide shutter is closed in conjunction with the operation of taking out the developer cartridge, and a position on the surface of the developing device where the sliding front end of the slide shutter is expected to reach at the end of the closing operation is located within a projecting area of the developer cartridge from its lower side.

The developer cartridge according to JP 11-149211 A which is detachably attachable to an electrophotographic image forming apparatus main body and serves to develop a latent image formed on an electrophotographic photosensitive member, includes: a cartridge frame; a developing unit that serves to develop a latent image formed on the electrophotographic photosensitive member; a driving force receiving member for receiving a driving force for rotating the developing unit from the electrophotographic image forming apparatus main body when attached to the apparatus main body; a shutter member capable of moving between a cover position where a portion of the developing unit which is exposed from the cartridge frame is covered and a retracted position where the shutter member is retracted from the cover position to allow the developing unit to be exposed from the cartridge frame; and a sheet member that is configured to cover a part of the cartridge frame along the longitudinal direction of the developing unit when the shutter member reaches the cover position.

The toner-replenishing container according to JP 2000-162861 A which is detachably attachable to a toner-replenishing device main body includes: an opening through which toner is replenished to the toner-replenishing device main body; a toner container main body that receives toner; and an opening/closing member that is capable of sliding in a first direction for opening/closing the opening with respect to the toner container main body. The toner-replenishing container is configured such that the opening/closing member is capable of sliding in a second direction different from the first direction with respect to the toner container main body, and when the opening/closing member is located in a closing position for closing the opening, the opening/closing member is prohibited from sliding in the first direction before sliding in the second direction.

However, the use of the above conventional arts raises the following problems. That is, in the case of the image forming apparatus according to JP 10-198145 A, the developer cartridge is formed into a cylindrical shape, so that if the developing device itself is miniaturized, the radius of the developer cartridge decreases accordingly, and the volume of the developer cartridge decreases in proportion to the second power of the radius. This leads to a problem in that the amount of the developer that can be received becomes relatively small.

Further, in the case of the developer cartridge according to JP 11-149211 A, a space where the developer cartridge is received is formed to have a sectional shape of a substantially fan shape obtained by dividing a circular shape into four, while the developer cartridge is formed into a substantially rectangular parallelepiped. This leads to a problem in that the overall size of the developing apparatus becomes large in size while sacrificing the volume of the developer cartridge.

Furthermore, in the case of the toner-replenishing container according to JP 2000-162861 A, the toner-replenishing container is configured such that the opening/closing member is capable of sliding in the second direction different from the first direction with respect to the toner container main body, and when the opening/closing member is located in the closing position for closing the opening, the opening/closing member is prohibited from sliding in the first direction before sliding in the second direction. This leads to a problem in that the opening/closing mechanism for the opening/closing member becomes complicated and the external shape of the opening/closing member lies off the external shape of the toner-replenishing container, so that an unnecessary space is required and an increase in size is inevitable.

SUMMARY OF THE INVENTION

The present invention has been made in view of the above circumstances and provides a developer cartridge, a developing apparatus using the developer cartridge, and an image forming apparatus, the developer cartridge making it possible to set the amount of developers that can be received to be large even when used in a miniaturized developing device and simplify the mechanism for opening/closing a supply outlet of the developer cartridge. As a result, the developer cartridge has no wasted space and thus can be miniaturized.

In order to solve the above-mentioned problems, according to an aspect of the present invention, there is provided a developer cartridge, including a developer receiving portion that receives a new developer, wherein a sectional shape of the developer receiving portion is formed into a shape that occupies a substantially entire space allocated to the developer cartridge to be attached.

Further, according to another aspect of the present invention, there is provided a developer cartridge which is provided corresponding to each of plural developing devices arranged along a rotation direction of a developing apparatus main body that is rotatably disposed, and supplies a developer containing at least toner to a corresponding one of the plural developing devices, the developer cartridge including a developer receiving portion that receives a new developer, wherein a sectional shape of the developer receiving portion in the rotation direction of the developing apparatus main body is formed into a non-circular shape that occupies a space excluding a space occupied by one of the plural developing devices from a space that is allocated to the one of the plural developing devices of the developing apparatus main body to which the developer cartridge is attached.

Here, the term "non-circular shape" represents a shape other than a circular shape, and is a generic term for the shapes including an elliptic shape, a substantially triangular shape, and a substantially teardrop shape.

Also, the phrase "a space excluding a space occupied by one of the plural developing devices from a space that is allocated to the one of the plural developing devices of the developing apparatus main body" represents the space allocated to the developer cartridge to be attached.

Further, according to another aspect of the present invention, there is provided a developing apparatus, including a developer cartridge including a developer receiving portion that receives a new developer, wherein:

development of an image is performed by supplying a developer from the developer cartridge; and a sectional shape of the developer receiving portion of the developer cartridge is formed into a shape that occupies a substantially entire space that is allocated to the developer cartridge to be attached.

Further, according to another aspect of the present invention, there is provided an image forming apparatus, including a developing apparatus including:

a developing apparatus main body that is rotatably disposed;

plural developing devices arranged along a rotation direction of the developing apparatus main body; and a developer cartridge that is provided corresponding to each of the plural developing devices and supplies a developer containing at least toner to a corresponding one of the plural developing devices, wherein:

an image is formed by sequentially developing electrostatic latent images formed on image bearing members by the plural developing devices of the developing apparatus;

the developer cartridge that supplies the developer containing at least toner to the corresponding one of the plural developing devices includes a developer receiving portion that receives a new developer; and a sectional shape of the developer receiving portion is formed into a shape that occupies a substantially entire space that is allocated to the developer cartridge to be attached.

As described above, according to the present invention, the developer cartridge, the developing apparatus using the developer cartridge, and the image forming apparatus can be provided, the developer cartridge making it possible to set the amount of developers that can be received to be large even when used in a miniaturized developing device, with the result that the developer cartridge has no wasted space and thus can be miniaturized.

BRIEF DESCRIPTION OF THE DRAWINGS

Preferred embodiments of the present invention will be described in detail based on the following figures, wherein.

DETAILED DESCRIPTION OF THE PREFERRED EMBODIMENT

Hereinafter, description will be made of an embodiment of the present invention with reference to the drawings.

Figure 2:
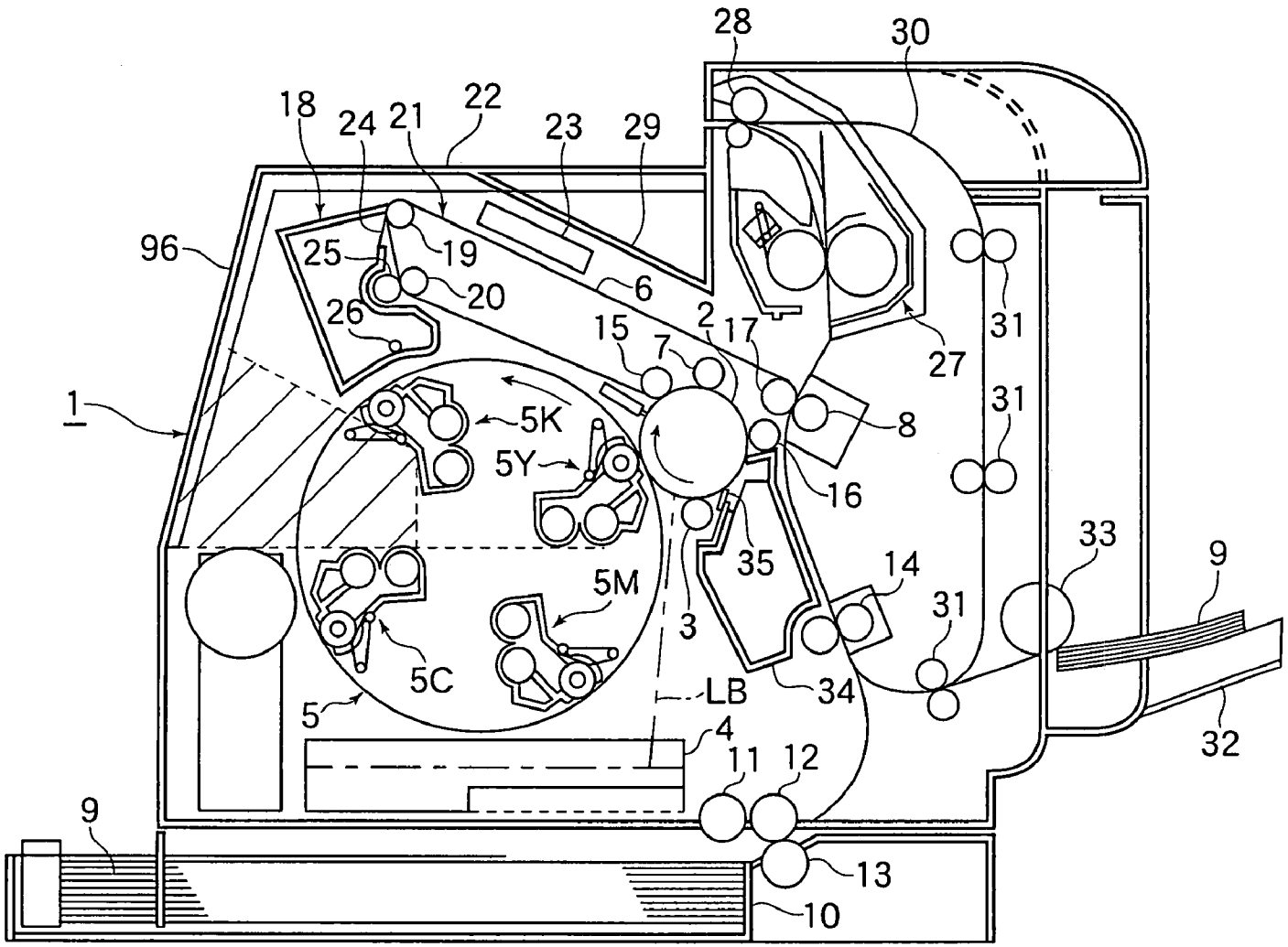
FIG. 2 shows a structure of a full-color printer serving as an image forming apparatus to which the developer cartridge and the developing apparatus are applied according to Embodiment 1 of the present invention.

Embodiment 1 FIG. 2 shows a full-color printer of a "four-cycle" system, which serves as an image forming apparatus to which a developer cartridge and a developing apparatus using the developer cartridge are applied according to Embodiment 1 of the present invention.

In FIG. 2, reference numeral 1 denotes the main body of a full-color printer. Disposed rotatably slightly in the upper right from the center of the full-color printer main body 1 is a photosensitive drum 2 serving as an image bearing member. The photosensitive drum 2 used herein is composed of, for example, an electrically-conductive cylindrical body with a diameter of approximately 47 mm whose surface is coated with a photosensitive layer made of an OPC or the like. The photosensitive drum 2 is driven by a drive unit (not shown) to rotate along the direction indicated by the arrow in the figure at a processing speed of approximately 150 mm/sec. The surface of the photosensitive drum 2 is charged to a predetermined potential by a charging roll 3 serving as a charging unit disposed substantially directly underneath the photosensitive drum 2. After the charging, the surface of the photosensitive drum 2 undergoes image exposure to form electrostatic latent images corresponding to respective image information. The image exposure is performed with a laser beam (LB) by a Raster Output Scanner (ROS) 4 serving as an exposure unit that is also disposed directly underneath the photosensitive drum 2 at a position spaced apart therefrom. The electrostatic latent images that have been sequentially formed on the photosensitive drum 2 are sequentially developed by a rotary developing apparatus 5, each becoming a toner image in a predetermined color. Arranged in the rotary developing apparatus 5 along its circumferential direction are developing devices 5Y, 5M, 5C, and 5K corresponding respectively to yellow (Y), magenta (M), cyan (C), and black (K).

For obtaining the toner image, the surface of the photosensitive drum 2 is subjected to the charging, the exposure, and the developing, which are repeated a predetermined number of times, according to the colors used for an image to be formed. In the rotary developing apparatus 5, the developing devices 5Y, 5M, 5C, and 5K corresponding to the respective colors move in turn to a developing position opposed to the photosensitive drum 2. For example, in the case of forming a full-color image, the surface of the photosensitive drum 2 is subjected to the charging, the exposure, and the developing, which are repeated four times in accordance with the respective colors of yellow (Y), magenta (M), cyan (C), and black (K). The toner images in the respective colors of yellow (Y), magenta (M), cyan (C), and black (K) are sequentially formed on the surface of the photosensitive drum 2. In the forming of the toner images, the number of revolutions of the photosensitive drum 2 varies depending upon the image size. In the case of the A4 size, for example, one image is formed by 3 revolutions of the photosensitive drum 2. That is, the toner images in the respective colors of yellow (Y), magenta (M), cyan (C), and black (K) are sequentially formed on the surface of the photosensitive drum 2 by every 3 revolutions of the photosensitive drum 2.

In a primary transfer position where an intermediate transfer belt 6 serving as an intermediate transfer member is partially wrapped around the circumference of the photosensitive drum 2, the toner images in the respective colors of yellow (Y), magenta (M), cyan (C), and black (K), which have been sequentially formed on the surface of the photosensitive drum 2, are subjected to a primary transfer by a primary transfer roll 7 onto the intermediate transfer belt 6 so as to be superimposed one on another. The toner images in the respective colors of yellow (Y), magenta (M), cyan (C), and black (K), which have been transferred onto the intermediate transfer belt 6 and superimposed one on another, are subjected to a secondary transfer by a secondary transfer roll 8 collectively onto a recording sheet 9 fed at a predetermined timing. The recording sheet 9 is sent out by a pickup roll 11 from a sheet feeding cassette 10 arranged in the lower portion of the full-color printer main body 1. After that, the recording sheet 9 is fed one by one by a feed roll 12 and a retard roll 13, and is transported to a secondary transfer position of the intermediate transfer belt 6 by registration rolls 14 in synchronization with the toner images transferred onto the intermediate transfer belt 6.

The intermediate transfer belt 6 is looped around plural rolls, and is driven so as to circulate at a predetermined processing speed (approximately 150 mm/sec), for example, in accordance with the rotation of the photosensitive drum 2. Specifically, the intermediate transfer belt 6 is stretched under a predetermined tension by: a wrap-in roll 15 for specifying a first wrapped position of the intermediate transfer belt 6 on the upstream side of the rotation direction of the photosensitive drum 2; the primary transfer roll 7 that transfers the toner image formed on the photosensitive drum 2 onto the intermediate transfer belt 6; a wrap-out roll 16 for specifying a second wrapped position of the intermediate transfer belt 6 on the downstream side of the first wrapped position; a backup roll 17 that abuts against the secondary transfer roll 8 across the intermediate transfer belt 6; and a first cleaning backup roll 19 and a second cleaning backup roll 20 that are each opposed to a cleaning device 18 for the intermediate transfer belt 6.

Further, the intermediate transfer belt 6 is stretched by the plural rolls denoted by reference numerals 7, 8, 15 to 17, 19, and 20 as described above, and is configured in this embodiment such that the sectional shape of the stretched intermediate transfer belt 6 is a substantially trapezoidal shape that is flat and elongate in order to aim at the miniaturization of the full-color printer main body 1.

In this embodiment, as shown in FIG. 2, the entire full-color printer is miniaturized to the greatest extent practicable, while the rotary developing apparatus 5 occupies a large space within the full-color printer main body 1. Therefore, the full-color printer main body 1 is designed so as to achieve the miniaturization thereof while improving maintainability of the intermediate transfer belt 6, the rotary developing apparatus 5, and the like. Specifically, the intermediate transfer belt 6 integrally composes an image forming unit 21 together with the photosensitive drum 2, the charging roll 3, and the secondary transfer roll 8. The image forming unit 21 is structured such that by opening an upper cover 22 of the full-color printer main body 1, the entire image forming unit 21 becomes detachably attachable to the full-color printer main body 1. In addition, disposed above the intermediate transfer belt 6 is a position sensor 23 composed of a reflective photosensor that detects a patch of toner formed on the intermediate transfer belt 6.

As shown in FIG. 2, the cleaning device 18 for the intermediate transfer belt 6 includes a scraper 24 that is disposed so as to abut against the surface of the intermediate transfer belt 6 stretched by the first cleaning backup roll 19, and a cleaning brush 25 that is disposed so as to be in press-contact with the surface of the intermediate transfer belt 6 stretched by the second cleaning backup roll 20. Residual toner and paper powder removed by the scraper 24 and the cleaning brush 25 are collected inside the cleaning device 18. The cleaning device 18 is disposed so as to be able to swing counterclockwise in the drawing about a swing shaft 26. According to its structure, the cleaning device 18 is withdrawn to a position apart from the surface of the intermediate transfer belt 6 until the end of the secondary transfer of a toner image in the last color, and abuts against the surface of the intermediate transfer belt 6 after the end of the secondary transfer of the toner image in the last color.

Further, as shown in FIG. 2, the recording sheet 9 onto which the toner image has been transferred from the intermediate transfer belt 6 is transported to a fixing device 27. In the fixing device 27, the toner image is fixed to the recording sheet 9 with heat and pressure. In the case of single-sided printing, the recording sheet 9 is delivered by delivery rolls 28 directly onto a delivery tray 29 provided in the upper portion of the full-color printer main body 1.

On the other hand, in the case of double-sided printing, the recording sheet 9 to which the toner image has been fixed by the fixing device 27 is not delivered by the delivery rolls 28 directly onto the delivery tray 29. Instead, with its trailing end portion being nipped by the delivery rolls 28, the recording sheet 9 undergoes reverse rotation of the delivery rolls 28 and switching of a transport path of the recording sheet 9 into a double-sided sheet transport path 30. The recording sheet 9 is then transported by transport rolls 31 disposed in the double-sided sheet transport path 30 to the secondary transfer position of the intermediate transfer belt 6 again with the front surface and rear surface being reversed, whereby an image is formed on the rear surface of the recording sheet 9.

Further, in the full-color printer, it is possible as shown in FIG. 2 to mount a manual feed tray 32 to a side surface of the full-color printer main body 1 so as to allow the opening and closing thereof. The recording sheet 9 of an arbitrary size and kind placed on the manual feed tray 32 is fed by a feed roll 33. The recording sheet 9 is then transported through the transport rolls 31 and the registration rolls 14 to the secondary transfer position of the intermediate transfer belt 6. Accordingly, an image can be formed even on the recording sheet 9 of an arbitrary size and kind.

The surface of the photosensitive drum 2 that has undergone the transferring of a toner image is cleaned each time the photosensitive drum 2 makes one revolution, by removing residual toner and the like with a cleaning blade 35 of a cleaning device 34 disposed diagonally below the photosensitive drum 2, thereby preparing for the subsequent image forming step.

In a rotary developing apparatus according to this embodiment, a developing apparatus main body is disposed so as to be rotatable within a vertical plane, the developing apparatus main body having plural developing devices arranged along its circumferential direction, and having developer cartridges which supply the plural developing devices with a developer containing at least toner and are arranged at positions corresponding to the plural developing devices. The rotary developing apparatus includes the developer cartridges having characteristics as described later.

Further, an image forming apparatus according to this embodiment includes a rotary developing apparatus in which a developing apparatus main body is disposed so as to be rotatable within a vertical plane, the developing apparatus main body having plural developing devices arranged along its circumferential direction, and having developer cartridges which supply the plural developing devices with a developer containing at least toner and are arranged at positions corresponding to the plural developing devices. In the image forming apparatus, electrostatic latent images that have been sequentially formed on a photosensitive member are sequentially developed by the respective plural developing devices of the developing apparatus to form an image. The image forming apparatus includes the developer cartridges having the characteristics as described later.

Figure 1:
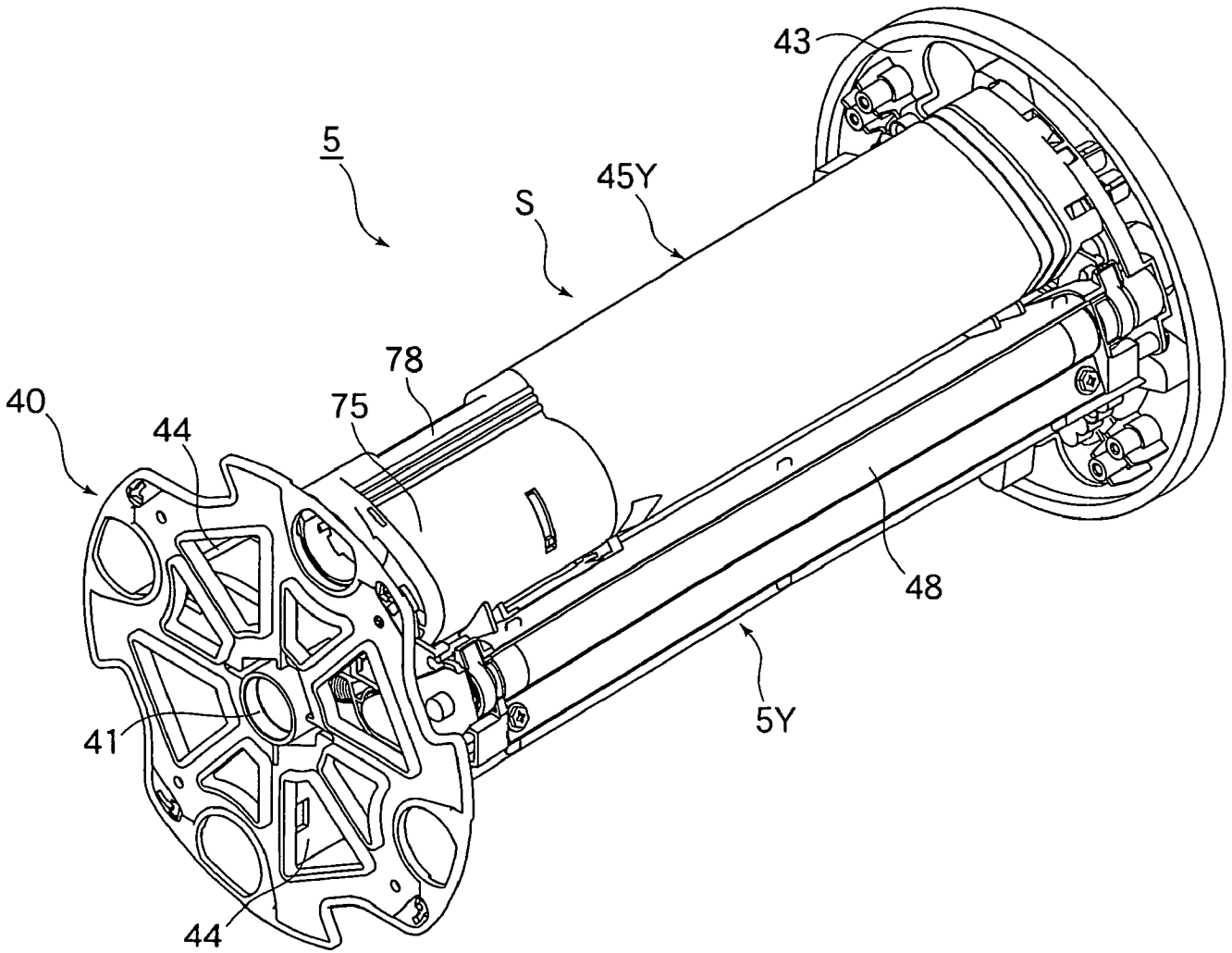
FIG. 1 is an external perspective view of a developing apparatus to which a developer cartridge is applied according to Embodiment 1 of the present invention.

FIG. 1 is an external perspective view of a specific example of the rotary developing apparatus 5 serving as a developing apparatus to which a developer cartridge is applied according to this embodiment of the present invention. Note that for convenience, FIG. 1 shows a state where the developing device 5Y and a developer cartridge 45Y are attached to a developing apparatus main body.

Figure 3:
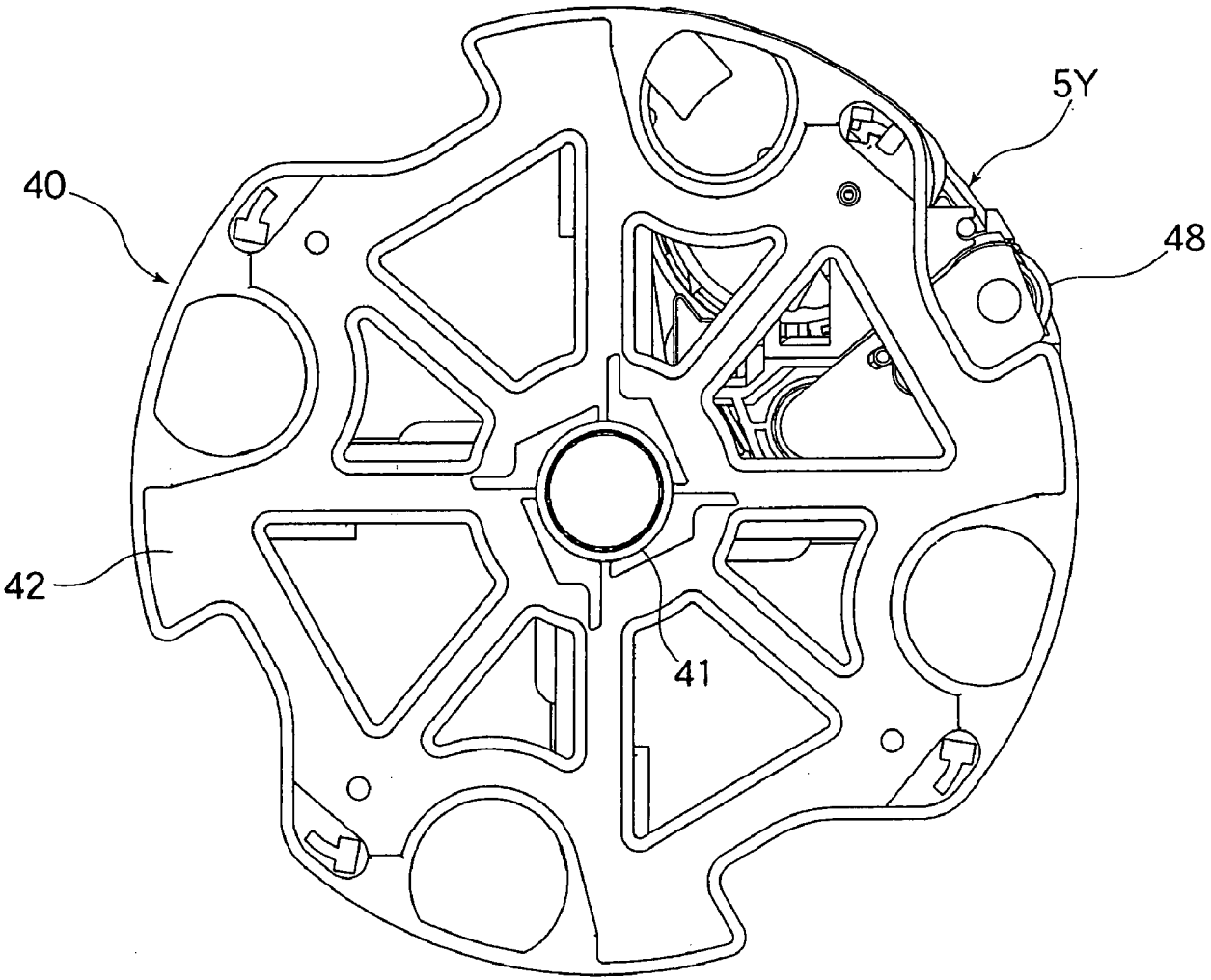
FIG. 3 is a side view of a developing apparatus main body.

As shown in FIGS. 1 and 3, the rotary developing apparatus includes a developing apparatus main body 40 disposed so as to be rotatable within a vertical plane. The developing apparatus main body 40 includes: a rotary shaft member 41 disposed in its central portion along the longitudinal direction; a front-side flange member 42 disposed in the front end portion of the rotary shaft member 41 in the longitudinal direction; a rear-side flange member 43 disposed in the rear end portion of the rotary shaft member 41 in the longitudinal direction; and partition members 44 that partition a cylindrical space S, which is defined by the rotary shaft member 41, the front-side flange member 42, and the rear-side flange member 43, into four sections at 90 degree intervals.

Figure 4:
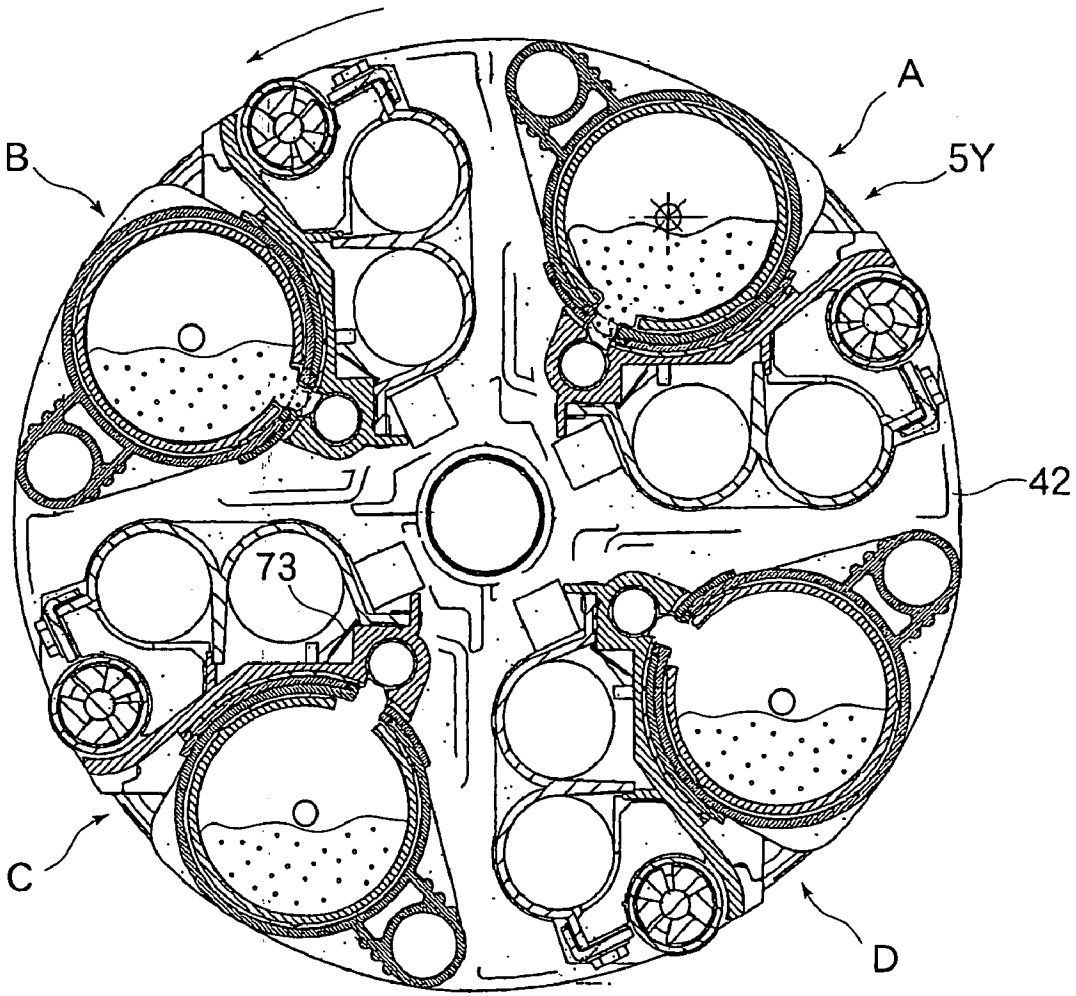
FIG. 4 is a sectional view of the developing apparatus.

As shown in FIG. 2, the developing apparatus main body 40 is attached to the full-color printer main body 1 so as to be rotatable along the counterclockwise direction with the rotary shaft member 41 as the center. As shown in FIG. 4, the four developing devices 5Y, 5M, 5C, and 5K respectively for yellow (Y), magenta (M), cyan (C), and black (K) are mounted to the developing apparatus main body 40 along its circumferential direction. In addition, four developer cartridges 45Y, 45M, 45C, and 45K respectively for yellow (Y), magenta (M), cyan (C), and black (K) are mounted to the developing apparatus main body 40 along its circumferential direction respectively in correspondence with the four developing devices 5Y, 5M, 5C, and 5K.

Figure 5:
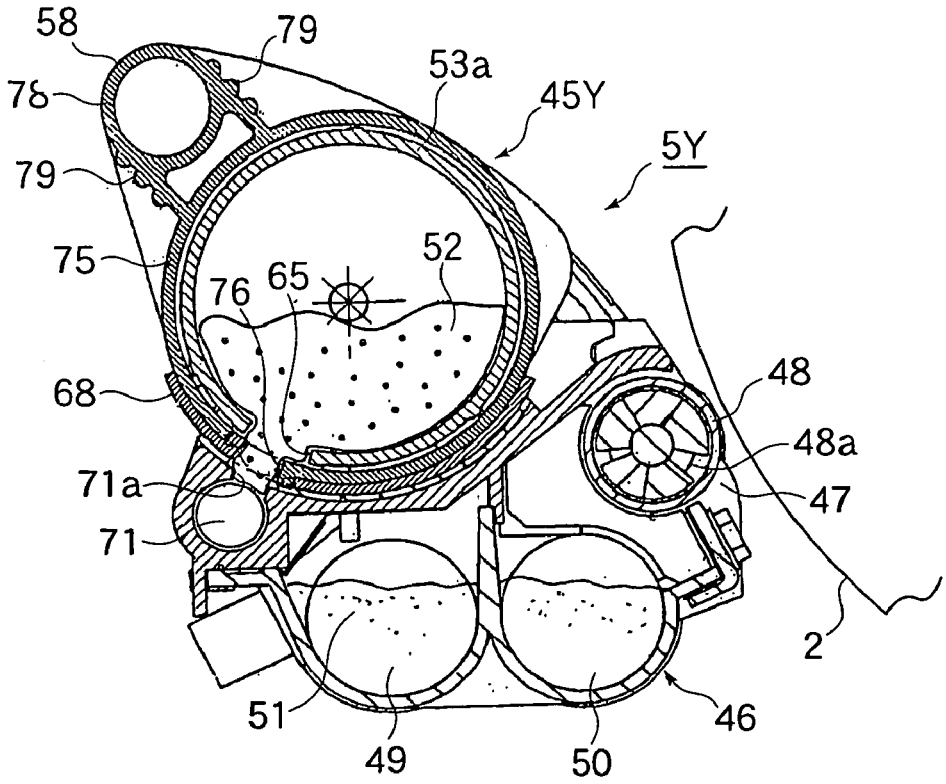
FIG. 5(A) is a sectional view of a developing device and a developer cartridge that are included in the developing apparatus.
FIG. 5(B) is a sectional view of a developing device and a developer cartridge that are included in the developing apparatus in another position.
Figure 5:
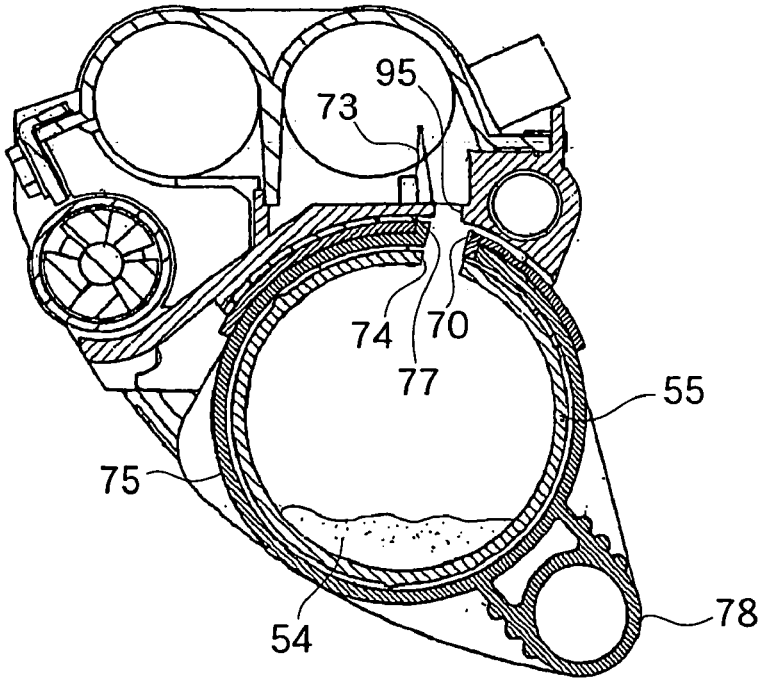

Since all the developing devices 5Y, 5M, 5C, and 5K have the same structure, the developing device 5Y for yellow (Y) will be described as an example herein. As shown in FIG. 5, the developing device 5Y for yellow (Y) includes a developing device main body 46 that is structured to be supplied with a new developer from the developer cartridge 45Y.

Figure 6:
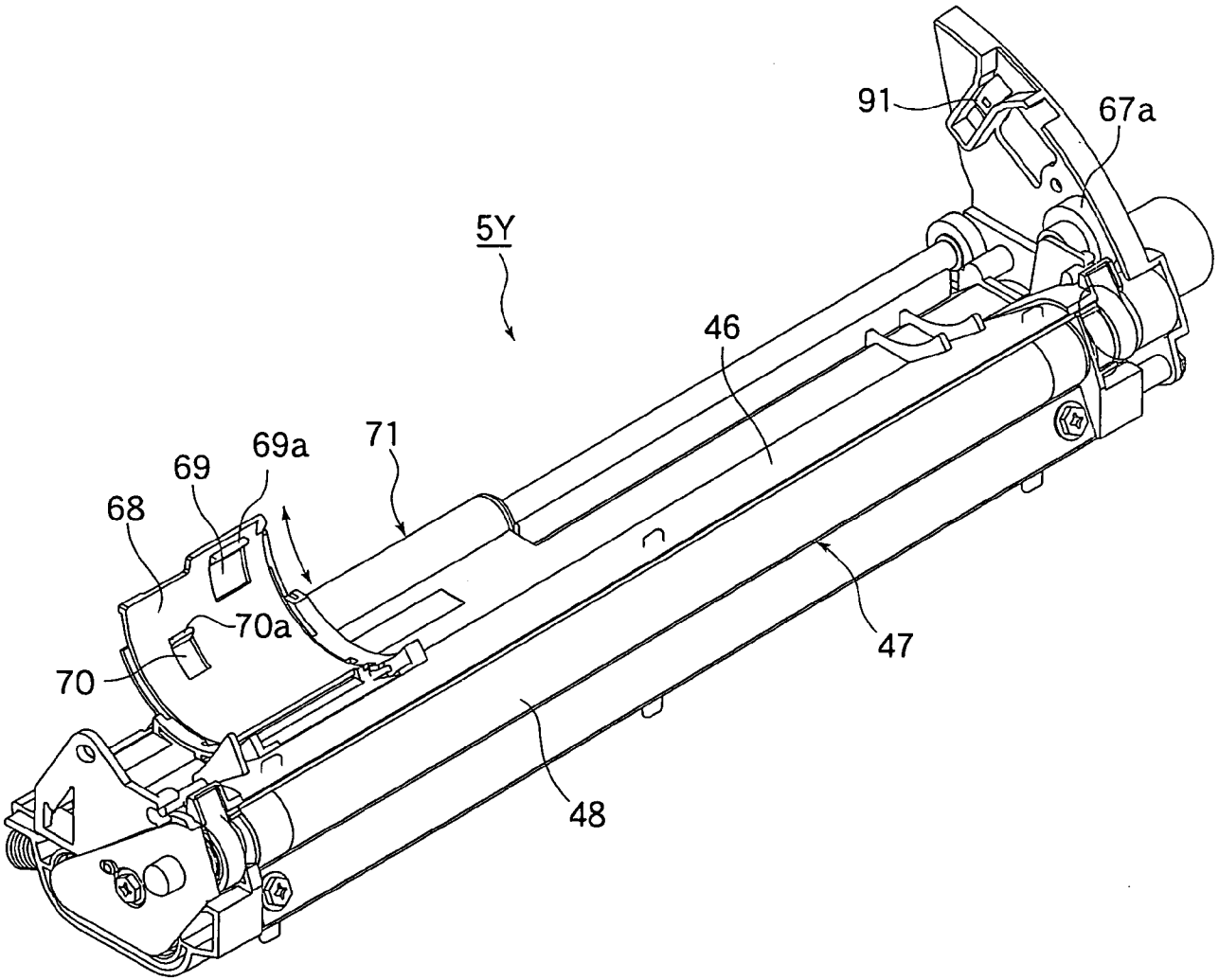
FIG. 6 is an external perspective view of the developing device.

As shown in FIG. 5, arranged inside the developing device main body 46 are a developing roll 48 that is elongate in a direction perpendicular to the paper surface of the drawing and is disposed with a part thereof exposed through an opening 47 formed so as to face the circumference of the developing device main body 46, and two spiral augers 49 and 50 that are located diagonally below the developing roll 48 on its rear side and extend in parallel with the developing roll 48. As shown in FIG. 6, the developing roll 48 is disposed along substantially the entire length of the developing device main body 46. In the developing device 5Y, as shown in FIG. 5, when the developing roll 48 rotates, the spiral auger 49 on the rear side carries a developer 51 received inside the developing device main body 46 in a direction perpendicular to the paper surface while agitating the developer 51. Meanwhile, the spiral auger 50 carries the developer 51 in the direction reverse to the carrying direction of the spiral auger 49 while agitating the developer 51. Accordingly, the developer 51 is uniformly supplied to the developing roll 48. The developer 51 supplied to the surface of the developing roll 48 has its film thickness regulated by a film thickness regulating member 52, and is carried to a developing area opposed to the photosensitive drum 2 in accordance with the rotation of the developing roll 48. Note that in this embodiment, a two-component developer composed of toner and carriers is used as the developer 51. However, any developer may be used as the developer 51 as far as it contains at least toner, and a mono-component developer composed of only toner may of course be used.

As shown in FIG. 5, by use of a magnet roll 48*a* fixed to its inside, the developing roll 48 adsorbs carriers contained in the developer 51 with a magnetic force to form a magnetic brush of the developer 51 on the surface of the developing roll 48, and carries toner adsorbed to the carriers to the developing area opposed to the photosensitive drum 2. Then, an electrostatic latent image formed on the photosensitive drum 2 is visualized by the magnetic brush of the developer 51 composed of carriers and toner which is formed on the surface of the developing roll 48.

Further, a developer cartridge according to this embodiment, which is provided corresponding to each of plural developing devices arranged along the circumferential direction of a developing apparatus main body that is disposed so as to rotatable within a vertical plane and supplies a developer containing at least toner to the corresponding one of the plural developing devices, includes a developer receiving portion that receives a new developer. In the developer cartridge, the sectional shape of the developer receiving portion is formed into a non-circular shape that substantially occupies the entirety of a space excluding a space occupied by one of the plural developing devices from a space that is allocated to the one of the plural developing devices of the developing apparatus main body to which the developer cartridge is attached.

Further, the developer cartridge according to this embodiment, which is provided corresponding to each of plural developing devices arranged along the circumferential direction of a developing apparatus main body that is disposed so as to rotatable within a vertical plane and supplies a developer containing at least toner to the corresponding one of the plural developing devices, includes a developer receiving portion that receives a new developer, and a developer collecting portion that is provided to one end of the developer receiving portion so as to extend in a longitudinal direction of the developer receiving portion and receives a used developer collected from the one of the plural developing devices. The developer cartridge is configured such that: the sectional shape of the developer receiving portion is formed into the non-circular shape that substantially occupies the entirety of the space excluding the space occupied by one of the plural developing devices from the space that is allocated to the one of the plural developing devices of the developing apparatus main body to which the developer cartridge is attached; and the sectional shape of the developer collecting portion is formed into a circular shape that is substantially inscribed in the space excluding the space occupied by the one of the plural developing devices from the space that is allocated to the one of the plural developing devices of the developing apparatus main body to which the developer cartridge is attached.

Further, according to this embodiment, the sectional shape of the developer receiving portion includes two lines corresponding to two side surfaces which form an acute angle therebetween.

Further, according to this embodiment, the sectional shape of the developer receiving portion is formed into a substantially teardrop shape.

Further, according to this embodiment, the developer cartridge includes: a supply outlet that is opened in the developer collecting portion so as to communicate with the developer receiving portion and serves to supply a developer to an outside; an opening/closing member that opens and closes the supply outlet; and a handle for gripping the developer cartridge to be attached to and detached from the developing apparatus main body, wherein the handle is unitarily formed with the opening/closing member.

Further, according to this embodiment, the opening/closing member is formed into such a cylindrical shape as to be inserted to rotatably fit to the circumference of the developer receiving portion, and the handle is provided to a part of the circumference of the opening/closing member so as to protrude toward its outward radial direction.

Further, according to this embodiment, the handle is configured to be received within a rotational circumference of the developing apparatus main body in the state where the developing apparatus main body is capable of rotating.

Further, according to this embodiment, the handle has a grip portion provided with a non-slip part.

Further, according to this embodiment, the developer cartridge further includes a lock mechanism that prevents the opening/closing member from rotating in the direction for opening the supply outlet in the state where the developer cartridge is removed from the developing apparatus main body.

Further, according to this embodiment, the developer cartridge further includes a stopper mechanism that prevents the developer cartridge from being removed from the developing apparatus main body in the state where the supply outlet is left open by the opening/closing member.

Further, according to this embodiment, the handle is configured to protrude toward the outside of the rotational circumference of the developing apparatus main body in the state where the developer cartridge can be removed from the developing apparatus main body.

Figure 7:
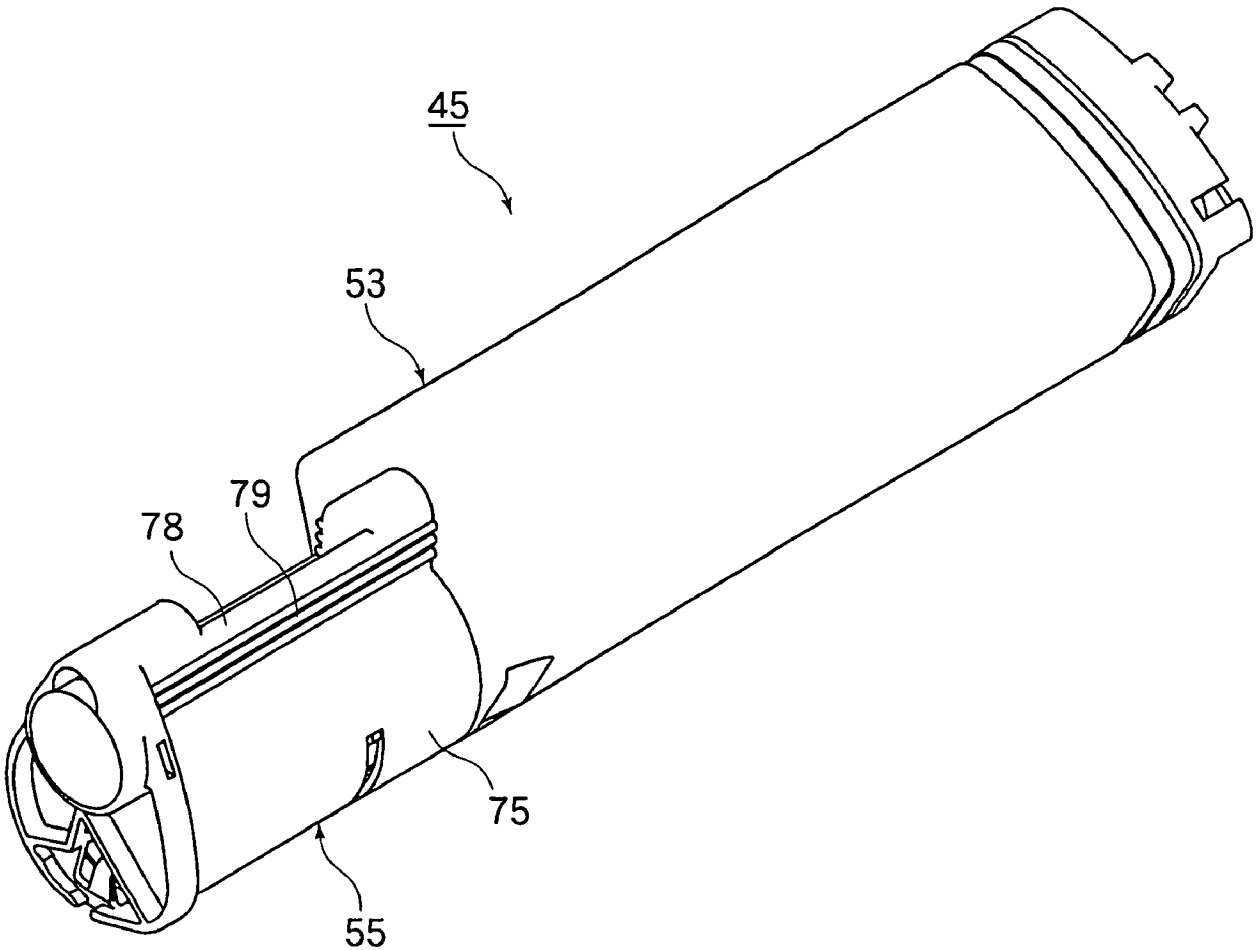
FIG. 7 is an external perspective view of the developer cartridge.
Figure 8:
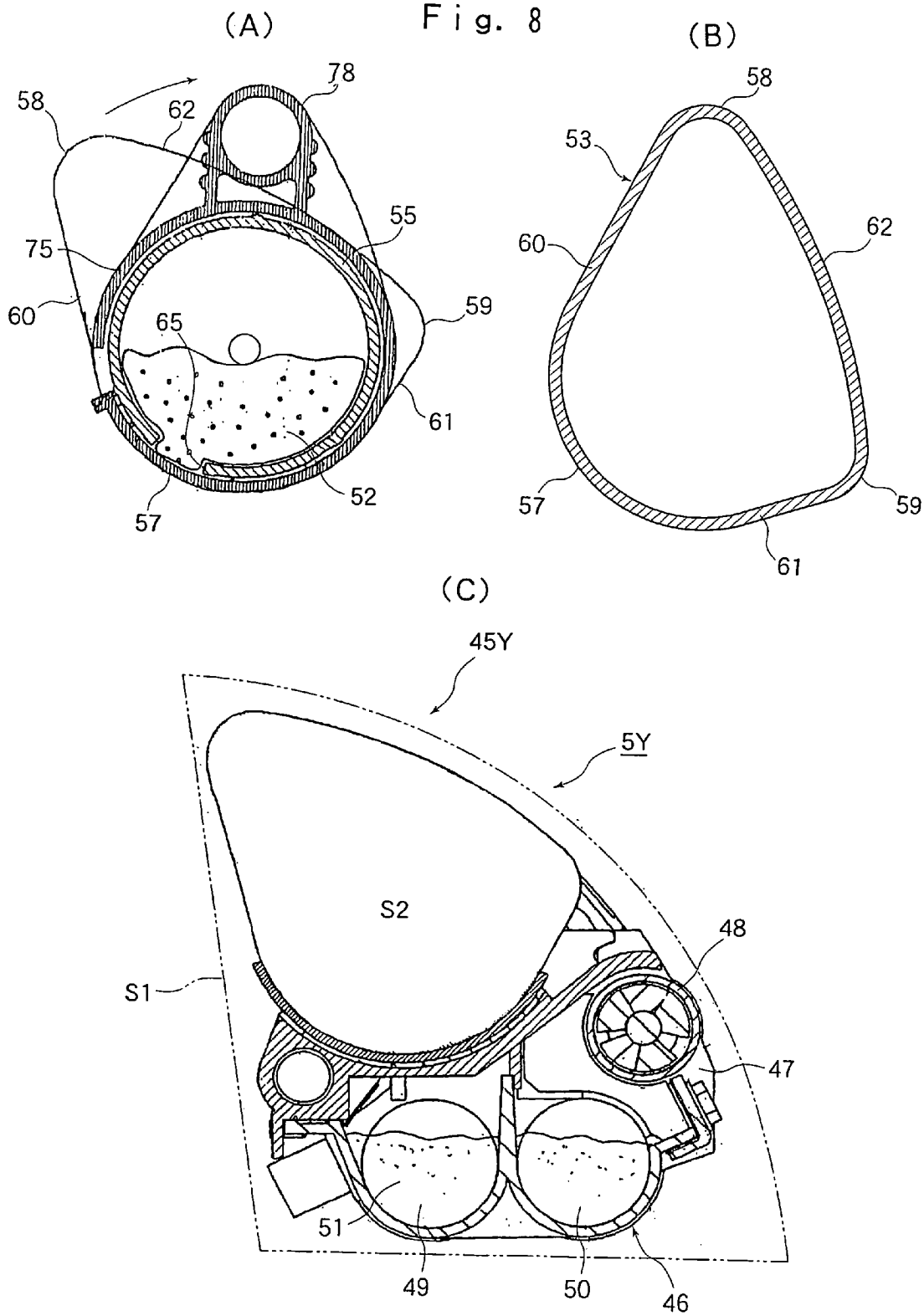
FIG. 8(A) is a cross sectional view of the developer cartridge.
FIG. 8(B) is across sectional view showing the developing cartridge in a different position.
FIG. 8(C) is across sectional view of the developing device.
Figure 9:
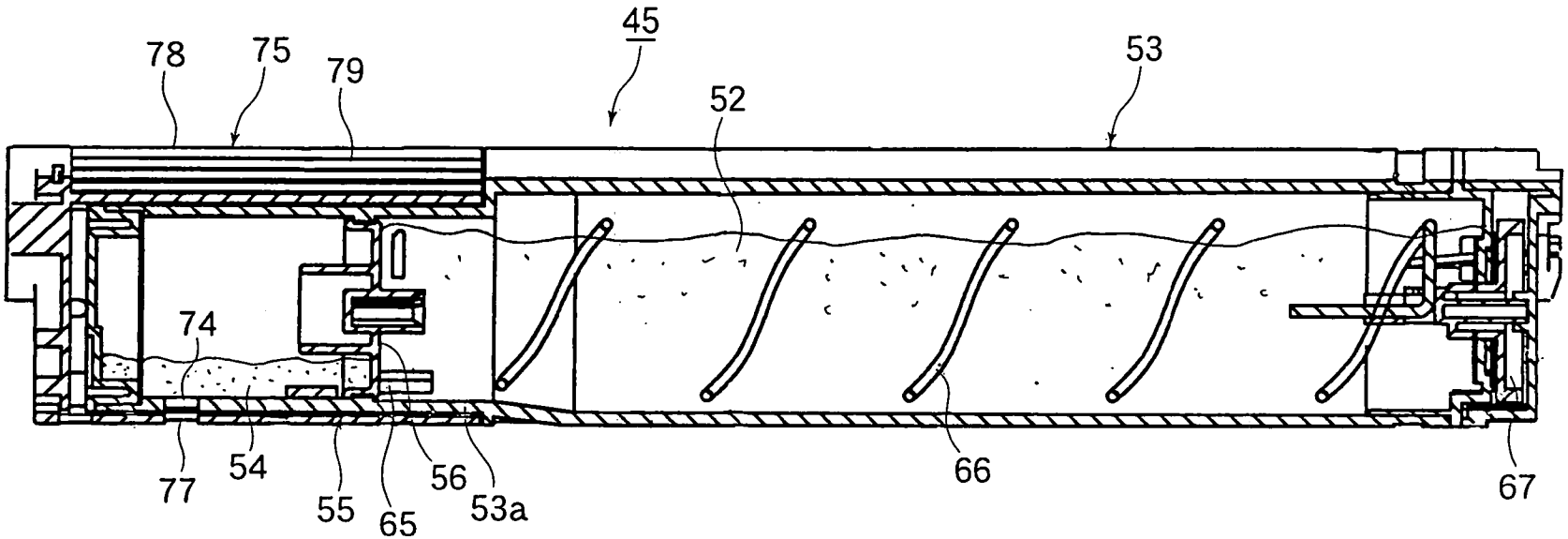
FIG. 9 is a longitudinal sectional view of the developer cartridge.

That is, as shown in FIGS. 1, 7, and 8, most of the developer cartridges 45 are formed of a container with a shape of a long, non-circular cylinder whose section is not circular. As shown in FIG. 9, the inside portion of the developer cartridge 45 is partitioned by a partitioning cap 56 into a developer receiving portion 53 that receives a new developer 52 and a developer collecting portion 55 in which a used developer 54 is collected and received. Note that this embodiment shown in the drawing is designed such that the developer receiving portion 53 and the developer collecting portion 55 occupy approximately 4/5 and 1/5 of the entire length of the developer cartridge 45, respectively. Other proportions may naturally be used for the ratio between the lengths of the developer receiving portion 53 and the developer collecting portion 55.

As shown in FIGS. 7 and 8, the developer receiving portion 53 of the developer cartridge 45 is formed to have a non-circular section, which is not a circular shape. As shown in FIG. 8, the developer receiving portion 53 is formed to have a section of substantially a triangular shape, in which a second corner portion 58 located at the apex is set to have a rather small angle and each of a first corner portion 57, the second corner portion 58, a third corner portion 59 has a circular arc, that is, a shape like an "omusubi (rice ball)" or a substantially teardrop shape. More specifically, the corner portion has the following sectional shape. That is, the first corner portion 57 located at the lower end forms a circular arc having a relatively large radius. A first side surface 60 and a second side surface 61 each formed into a substantially planar shape are arranged in a substantially notched shape with an angle of approximately 60 degrees with the first corner portion 57 as the center. The second corner portion 58 and the third corner portion 59 located at the tips of the first side surface 60 and the second side surface 61, respectively, each form a circular arc having a smaller radius than the first corner portion 57, the circular arcs of the second corner portion 58 and the third corner portion 59 having substantially the same radius. A third side surface 62 connecting the second corner portion 58 and the third corner portion 59 is formed, as shown in FIG. 4, into a circular arc having a large radius substantially the same as the radius of the front-side flange member 42 of the rotary developing apparatus 5.

As a result, as shown in FIG. 8(*c*), the developer receiving portion 53 of the developer cartridge 45 is formed to have not a circular shape but such a non-circular shape as to occupy substantially the entirety of a space S2 within a space S1. The space S1 is allocated to the developing device 5Y which is one of the developing devices of the developing apparatus main body 40 to which the developer cartridges 45 are attached. The space S2 is the space excluding the space occupied by the developing device 5Y from the space S1, that is, the space occupied by the attached developer cartridge 45. Accordingly, even in the case where the whole rotary developing apparatus 5 is miniaturized and set to have a small diameter, the developer receiving portion 53 can receive as much the new developer 52 as possible.

Meanwhile, as shown in FIGS. 8(*a*) and 8(*c*), the developer collecting portion 55 connected to one end side of the developer receiving portion 53 is formed to have a circular section which is substantially inscribed in the space S2 excluding the space occupied by the developing device 5Y from the space S1 allocated to the developing device 5Y which is one of the developing devices of the developing apparatus main body 40 to which the developer cartridges 45 are attached, and which is slightly smaller in diameter than the space S2. As shown in FIG. 9, the developer collecting portion 55 is integrally formed on one end side of the developer receiving portion 53 in the longitudinal direction thereof into a cylindrical shape having a circular section, and the partitioning cap 56 is disposed at the end of the developer collecting portion 55 on the developer receiving portion 53 side. Note that the developer collecting portion 55 may be formed, if necessary, into a circular shape that is substantially inscribed in the space S2, which is the space excluding the space occupied by the developing device 5Y, and is larger in diameter than the space S2.

More specifically, as shown in FIG. 9, the developer receiving portion 53 has its end portion on the developer collecting portion 55 side formed to be slightly thinner, and is connected to the developer collecting portion 55 with a cylindrical shape. As a result, the developer receiving portion 53 has an end portion 53*a* on the developer collecting portion 55 side formed into the same cylindrical shape as the developer collecting portion 55. As shown in FIG. 9, the cylindrical-shaped end portion 53*a* of the developer receiving portion 53 includes a supply outlet 65 for supplying the new developer 52 to the outside at the end on the developer collecting portion 55 side, which is a rectangular opening formed in a slightly oblique position. Disposed rotatably inside the developer receiving portion 53 is an agitator 66 having a spiral shape which carries the new developer 52 received inside the developer receiving portion 53 while agitating it. The agitator 66 carries the new developer 52 in order to supply it to the outside from the supply outlet 65. A gear 67 serving to drive the agitator 66 to rotate is disposed in the rear end portion of the developer cartridge 45 so as to have a part thereof exposed to the outside. As shown in FIG. 6, in the state where the developer cartridge 45 is attached to the developing device main body 46, the gear 67 meshes with a gear 67*a* provided to the developing device main body 46, and is configured such that the agitator 66 is driven to rotate.

Note that the first corner portion 57 of the developer receiving portion 53 is a curved surface with a small curvature radius which is configured to have substantially the same center as the rotation center of the agitator 66 serving as an agitating member that agitates a developer inside the developer cartridge 45.

As shown in FIG. 6, the developing device 5Y to which the new developer 52 is supplied from the developer cartridge 45 includes a shutter plate 68, which is provided on the developing device side in the state of being curved in a substantially circular arc and configured to abut against a portion corresponding to the supply outlet 65 of the developer cartridge 45. The shutter plate 68 is attached to the developing device main body 46 so as to be slidable along the arrow direction of FIG. 6. The shutter plate 68 has an opening as a supply inlet 69 that receives the new developer 52 supplied from the developer cartridge 45, and a convex piece 69*a* provided to the circumferential end of the supply inlet 69 so as to protrude inward. As shown in FIGS. 5 and 6, the developing device 5Y supplied with the new developer 52 from the supply inlet 69 is disposed over a predetermined length in an upper portion on the rear side of the developing device main body 46. In the developing device 5Y, a supply auger 71 having a supply port 71*a* for a developer at its entrance carries the developer by a predetermined distance along the longitudinal direction of the developing device main body 46, and then the developer is supplied to the inside of the developing device main body 46 from an opening portion for supply (not shown) provided to an upper portion on the rear side of the developing device main body 46.

In order to collect a used developer in the developer 51 received inside the developing device main body 46, as shown in FIG. 5(*b*), the developing device 5Y includes an opening portion 95 for collection, which is provided to an upper portion on the rear side of the developing device main body 46, and is configured such that when the developing device 5Y rotates to reach a position C of FIG. 4, a flap 73 opens to collect the used developer 54. As shown in FIG.

5(*b*), the used developer 54 collected from the developing device 5Y is collected to the inside of the developer collecting portion 55 of the developer cartridge 45 through a discharge port 70 for collection provided to the shutter plate 68 as an opening (see FIG. 6) and a collection port 74 provided to the developer cartridge 45 as an opening (see FIG. 9). Note that as shown in FIG. 6, a convex piece 70*a* is similarly provided to the discharge port 70 for collection in the developing device 5Y so as to protrude inward.

In this embodiment, as shown in FIGS. 5 and 9, a shutter member 75 serving as an opening/closing member that opens and closes the supply outlet 65 of the developer receiving portion 53 and the collection port 74 of the developer collecting portion 55 is inserted to fit to the circumference of the developer receiving portion 53 and the developer collecting portion 55, which are formed in a cylindrical shape, of the developer cartridge 45 so as to be rotatable along the circumferential direction. As shown in FIGS. 5 and 7, the shutter member 75 is formed into a cylindrical shape similarly to the developer receiving portion 53 and the developer collecting portion 55 of the developer cartridge 45. However, the inner diameter of the shutter member 75 is slightly larger than the outer diameter of the developer collecting portion 55, and as shown in FIGS. 5 and 8(*c*), the shutter member 75 is formed into a circular shape that is substantially inscribed in the space S2 in the space S1 allocated to the developing device 5Y which is one of the developing devices of the developing apparatus main body 40 to which the developer cartridges 45 are attached.

Figure 10:
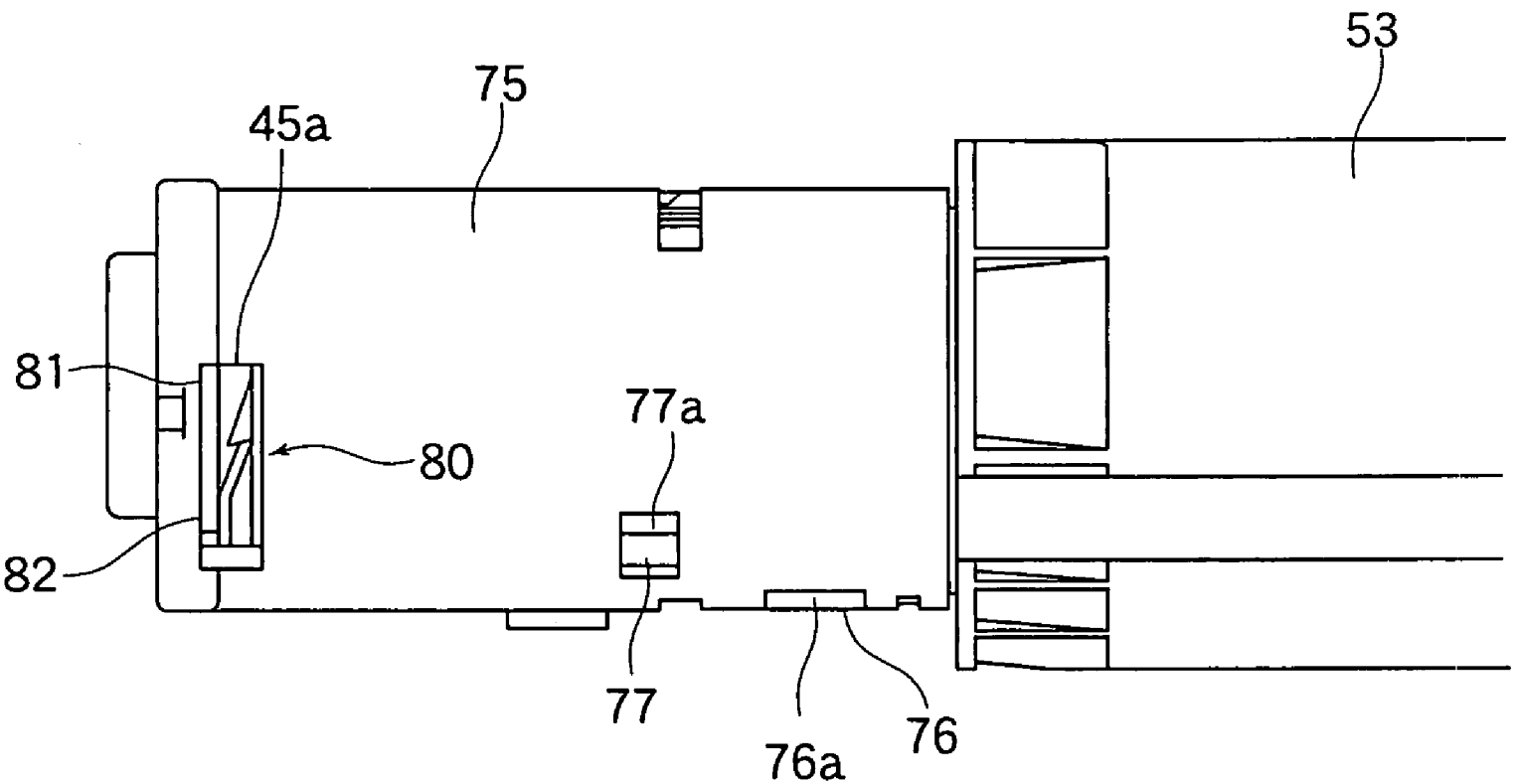
FIG. 10 is a bottom view of a main portion of the developer cartridge.

As shown in FIGS. 5, 9, and 10, the shutter member 75 has two openings as an opening portion 76 for supply and an opening portion 77 for collection in positions corresponding respectively to the supply outlet 65 and collection port 74 of the developer cartridge 45. The shutter member 75 is rotated along the circumference of the developer collecting portion 55 of the developer cartridge 45 to allow the simultaneous opening or closing of the supply outlet 65 and collection port 74 of the developer cartridge 45. Note that convex pieces 76*a* and 77*a* are provided to the edge of the opening portion 76 for supply and opening portion 77 of the shutter member 75 so as to protrude outward.

As shown in FIG. 7, the shutter member 75 also has a handle 78, which is provided in a part of the circumferential direction thereof so as to protrude outward in the radial direction and used for rotating the shutter member 75 and gripping the developer cartridge 45 to attach it to the developing device main body 46. As shown in FIG. 5, the handle 78 has a curvature radius at the tip set so as to match with the second corner portion 58 of the developer receiving portion 53 of the developer cartridge 45 in the state where the developer cartridge 45 is attached to the developing device main body 46 and the shutter member 75 is open. The side surface of the handle 78 is provided with a non-slip portion 79 composed of plural convex strips allowing easy grip.

As shown in FIG. 8, the shutter member 75 is configured such that the handle 78 protrudes from the circumference of the developing device main body 46 in the state where the shutter member 75 is rotated clockwise and the supply outlet 65 and collection port 74 of the developer cartridge 45 are closed.

Figure 11:
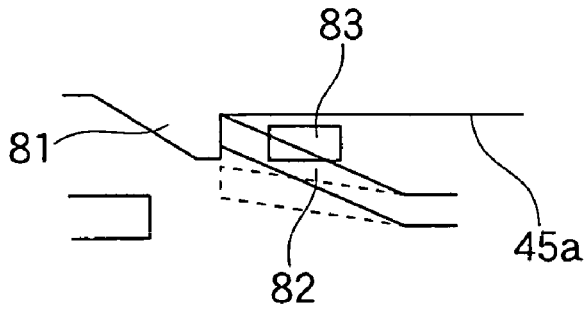
FIG. 11 shows a structure of a lock mechanism.
Figure 12:
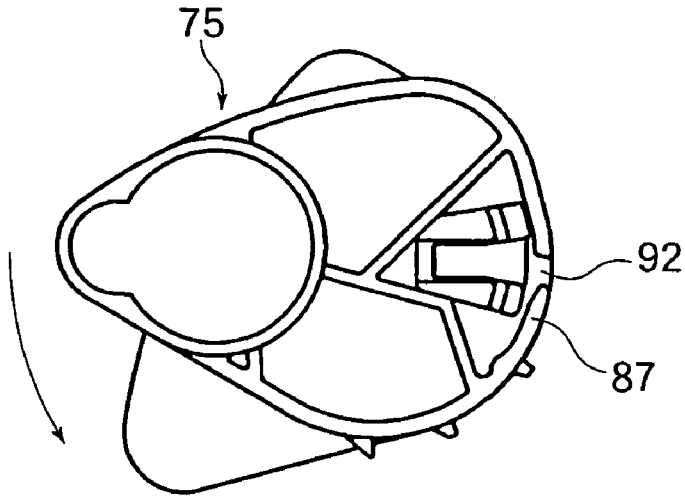
FIG. 12 shows a structure of the developer cartridge whose lock mechanism is being operated.

As shown in FIG. 10, the shutter member 75 is also provided with a lock mechanism 80 that prevents the shutter member 75 from erroneously rotating in the direction for opening the supply outlet 65 and collection port 74 of the developer cartridge 45 in the state where the developer cartridge 45 is removed from the developing device main body 46. As shown in FIG. 11, the lock mechanism 80 includes an abutment portion 81 formed on a front-side end surface 45*a* of the developer cartridge 45, and an engagement piece 82 that is capable of elastically deforming and protrusively provided to the inner surface of the shutter member 75 so as to engage with the abutment portion 81. In the state where the developer cartridge 45 is removed from the developing device main body 46, the engagement piece 82 protrusively provided to the inner surface of the shutter member 75 is engaged with the abutment portion 81 formed on the front-side end surface 45*a* of the developer cartridge 45. Thus, as shown in FIG. 12, the shutter member 75 is prevented from rotating in the direction for opening the supply outlet 65 and collection port 74 of the developer cartridge 45. Further, when the developer cartridge 45 is attached to a predetermined position of the developing device main body 46, as indicated by the broken line of FIG. 11, a protrusion 83 that is protrusively provided in a predetermined position of the developing device main body 46 causes the engagement piece 82 of the developing device main body 46 to elastically deform to release the engagement with the abutment portion 81, thereby allowing the rotation of the shutter member 75 in the direction for opening the supply outlet 65 and collection port 74 of the developer cartridge 45.

Figure 13:
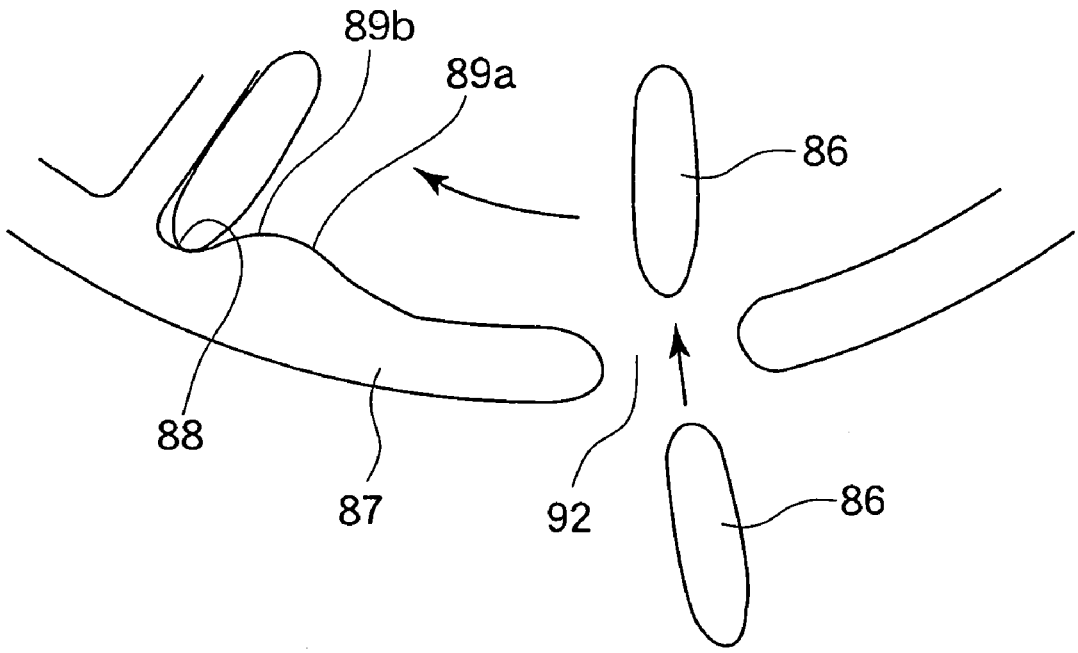
FIG. 13 shows a structure of a stopper mechanism.

In addition, in this embodiment, a stopper mechanism 85 is provided, which prevents the developer cartridge 45 from being removed from the developing device main body 46 in the state where the developer cartridge 45 is attached to a predetermined position of the developing device main body 46 and the shutter member 75 remains open. With the stopper mechanism 85, when the developer cartridge 45 is attached in the predetermined position of the developing device main body 46 and the shutter member 75 is rotated in the direction for opening the shutter member 75, as shown in FIG. 13, an engagement plate portion 86 that is protrusively provided in a predetermined position of the developing device main body 46 is engaged with an engagement concave portion 88 that is provided to the inner periphery of a flange 87 provided to the end surface of the shutter member 75. In that state, the engagement plate portion 86 protrusively provided to the developing device main body 46 abuts against the engagement concave portion 88 of the shutter member 75, so that the developer cartridge 45 cannot be removed from the developing device main body 46 as long as the shutter member 75 is not rotated in the closing direction.

As shown in FIG. 13, the flange 87 of the shutter member 75 has an inclined surface 89*b* formed as a slope between the engagement concave portion 88 and a crest portion 89*a* that curves smoothly. When passing the crest portion 89*a* in accordance with the rotation of the shutter member 75, the engagement plate portion 86 is guided to the engagement concave portion 88 along the slope of the inclined surface 89*b*, making it always possible to reliably attach the developer cartridge 45 in a predetermined position of the developing device main body 46.

Figure 14:
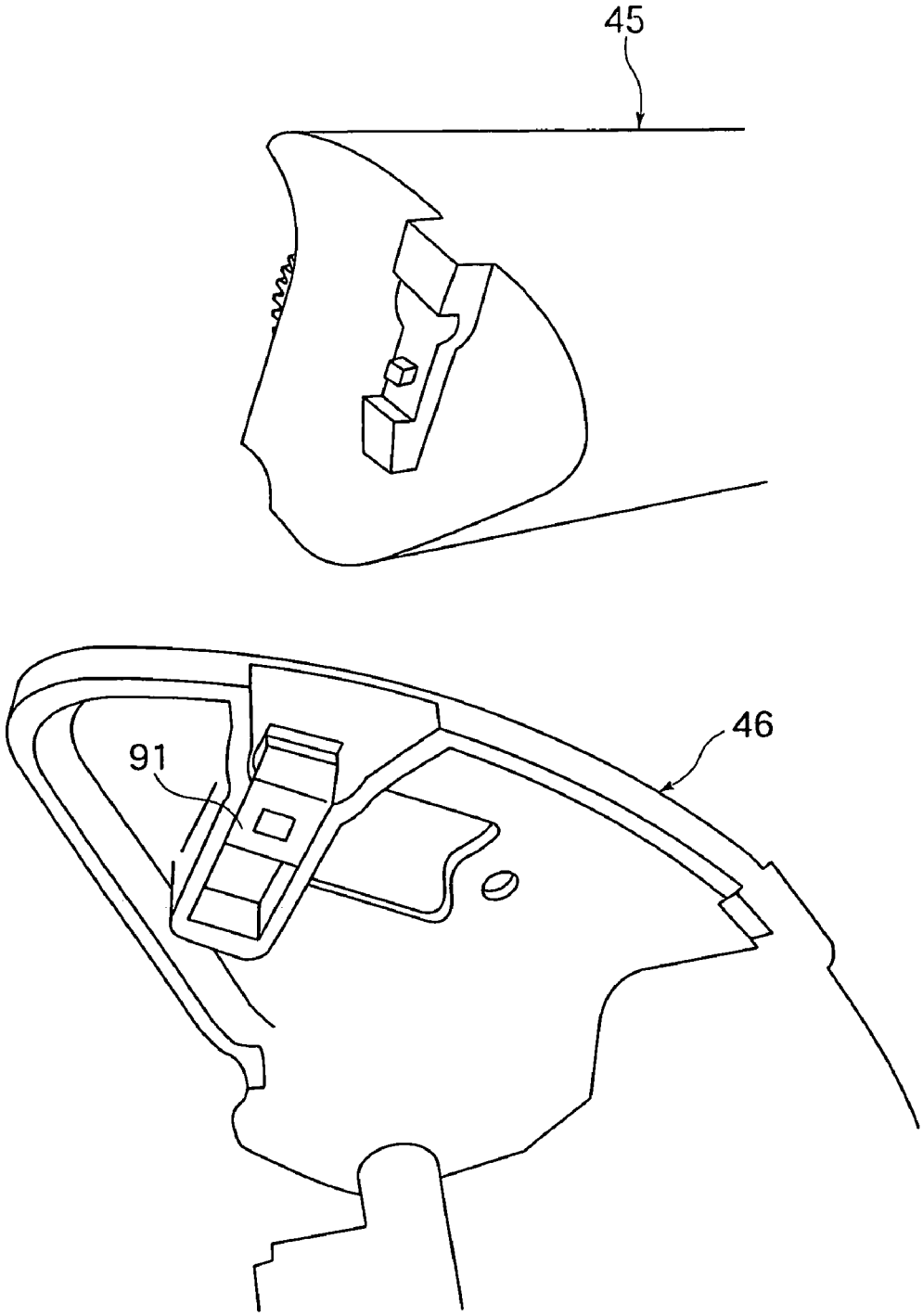
FIG. 14 shows a structure of a guide mechanism of the developer cartridge.
Figure 15:
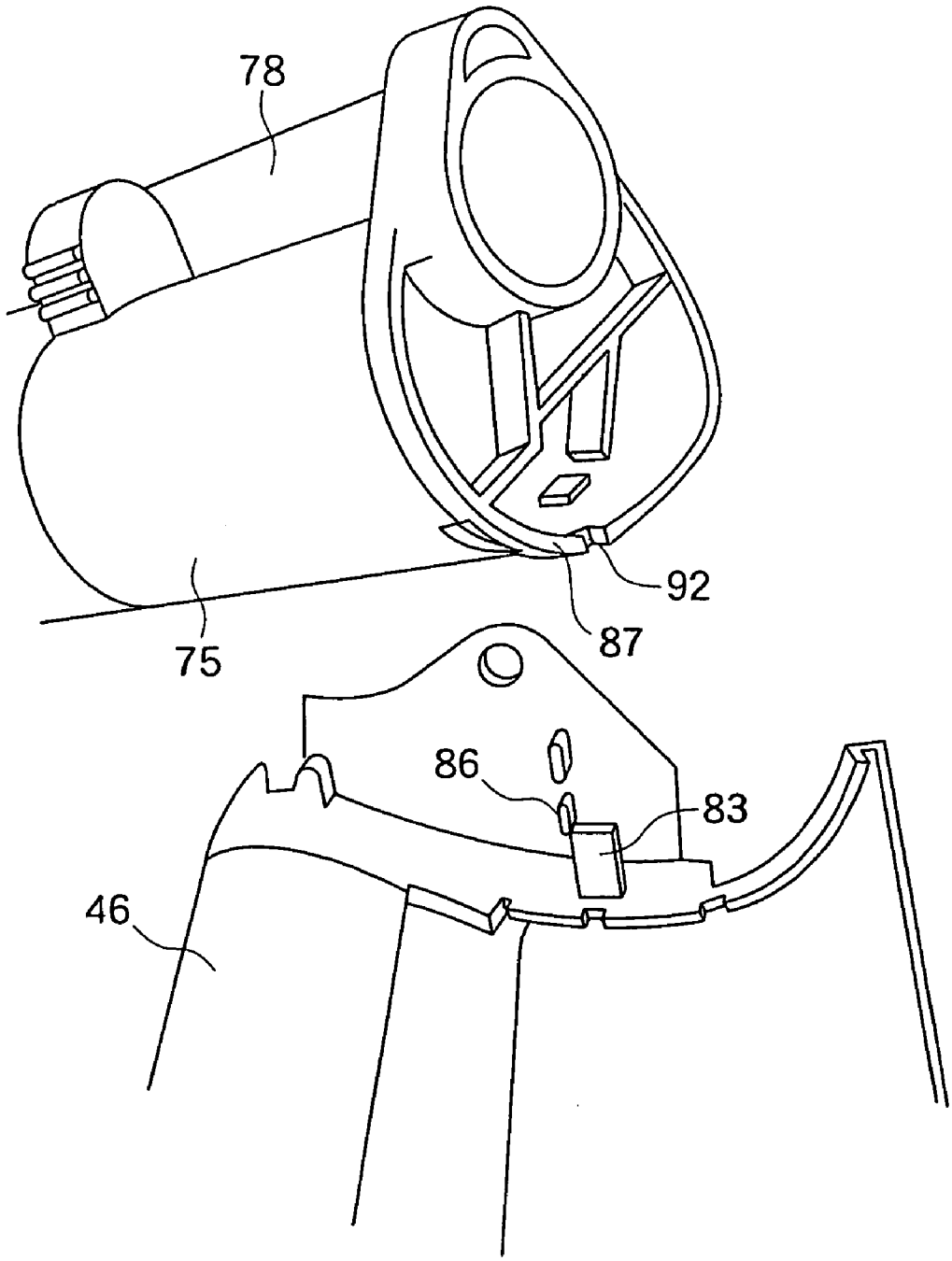
FIG. 15 shows another structure of the guide mechanism of the developer cartridge.

In this embodiment, when the developer cartridge 45 is attached in a predetermined position of the developing device main body 46, the developer cartridge 45 is slid toward substantially the center of the developing device main body 46 from its outward radial direction. Accordingly, as shown in FIG. 14, a sliding portion 90 that is protrusively provided to the rear-side end surface of the developer cartridge 45 engages with a plate spring 91 for engagement provided in the corresponding position of the developing device main body 46, while as shown in FIGS. 13 and 15, the engagement plate portion 86 that is protrusively provided to the developing device main body 46 is guided through a guide gap 92 formed to the flange 87 of the shutter member 75 that is protrusively provided to the front-side end surface of the developer cartridge 45.

According to the above configuration, in the full-color printer serving as the image forming apparatus to which the developer cartridge and the developing apparatus are applied according to this embodiment, it is made possible by the following procedure to set the amount of developers that can be received to be large even when a developing device of the printer is miniaturized and to simplify the mechanism for opening/closing the supply outlet of the developer cartridge. As a result, the full-color printer has no wasted space and thus can be miniaturized.

In the full-color printer, as shown in FIGS. 2 and 4, the new developers 52 for respective predetermined colors are supplied to the corresponding developing devices 5Y, 5M, 5C, and 5K from the corresponding developer cartridges 45, so that printing operation for a color image is performed.

As shown in FIGS. 1, 5, and 8, the developer receiving portion 53 of the developer cartridge 45 is formed to have not a circular section but such a non-circular shape as to occupy substantially the entirety of the space S2 excluding the space occupied by the developing device 5Y from the space S1 that is allocated to the developing device 5Y which is one of the developing devices of the developing apparatus main body 40 to which the developer cartridges 45 are attached. Accordingly, even in the case where the whole rotary developing apparatus 5 is miniaturized and set to have a small diameter, the developer receiving portion 53 can receive as much the new developer 52 as possible.

Therefore, even in the case of miniaturizing the rotary developing apparatus 5, the developer receiving portion 53 of the developer cartridge 45 can receive as much the new developer 52 as possible, thus allowing, for example, the printing of approximately 4000 of A4-size sheets if images are formed thereon using monochrome single color to have a density of 5%.

Next, in the full-color printer, as shown in FIG. 2, as the printing operation is repeated, the new developer 52 received inside the developer cartridge 45 attached to the rotary developing apparatus 5 is gradually consumed, and the developer cartridge 45 finally becomes empty of the new developer 52. Then, it is necessary to replace the developer cartridge 45 with a new one.

Figure 16:
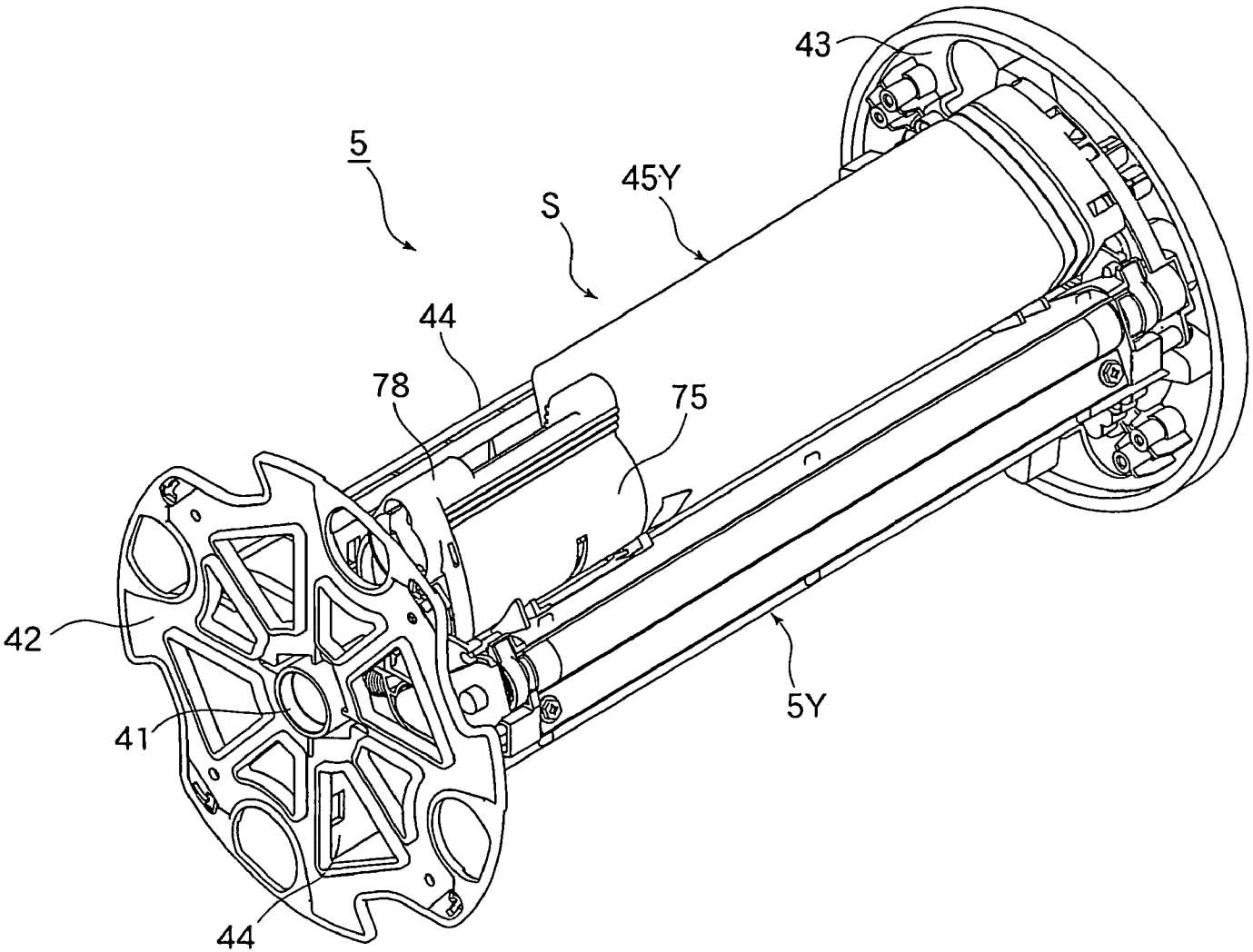
FIG. 16 is another external perspective view of the developing apparatus to which the developer cartridge is applied according to Embodiment 1 of the present invention.

In that case, in the state where the respective developing devices 5Y, 5M, 5C, and 5K are in the locations as indicated in FIG. 2, the rotary developing apparatus 5 is stopped. Then, a side cover 96 provided to the side surface of the full-color printer main body 1 is opened, and in the position indicated by symbol B of FIG. 4, the developer cartridge 45 to be replaced is removed. At that time, in the developer cartridge 45, as shown in FIG. 16, the handle 78 of the shutter member 75 is gripped by a hand, and the shutter member 75 is gradually rotated clockwise.

Then, as shown in FIG. 8(*a*), in the developer cartridge 45, the supply outlet 65 and collection port 74 of the developer cartridge 45 are closed by the shutter member 75 in accordance with the rotation of the shutter member 75. At that time, as shown in FIG. 17, the new developer 52 existing in the supply outlet 65 of the developer cartridge 45 is leveled off with the edge of the opening portion 76 of the shutter member 75, and the supply outlet 65 of the developer cartridge 45 is closed while no developer exists at the edge of the opening portion 76 of the shutter member 75.

Figure 18:
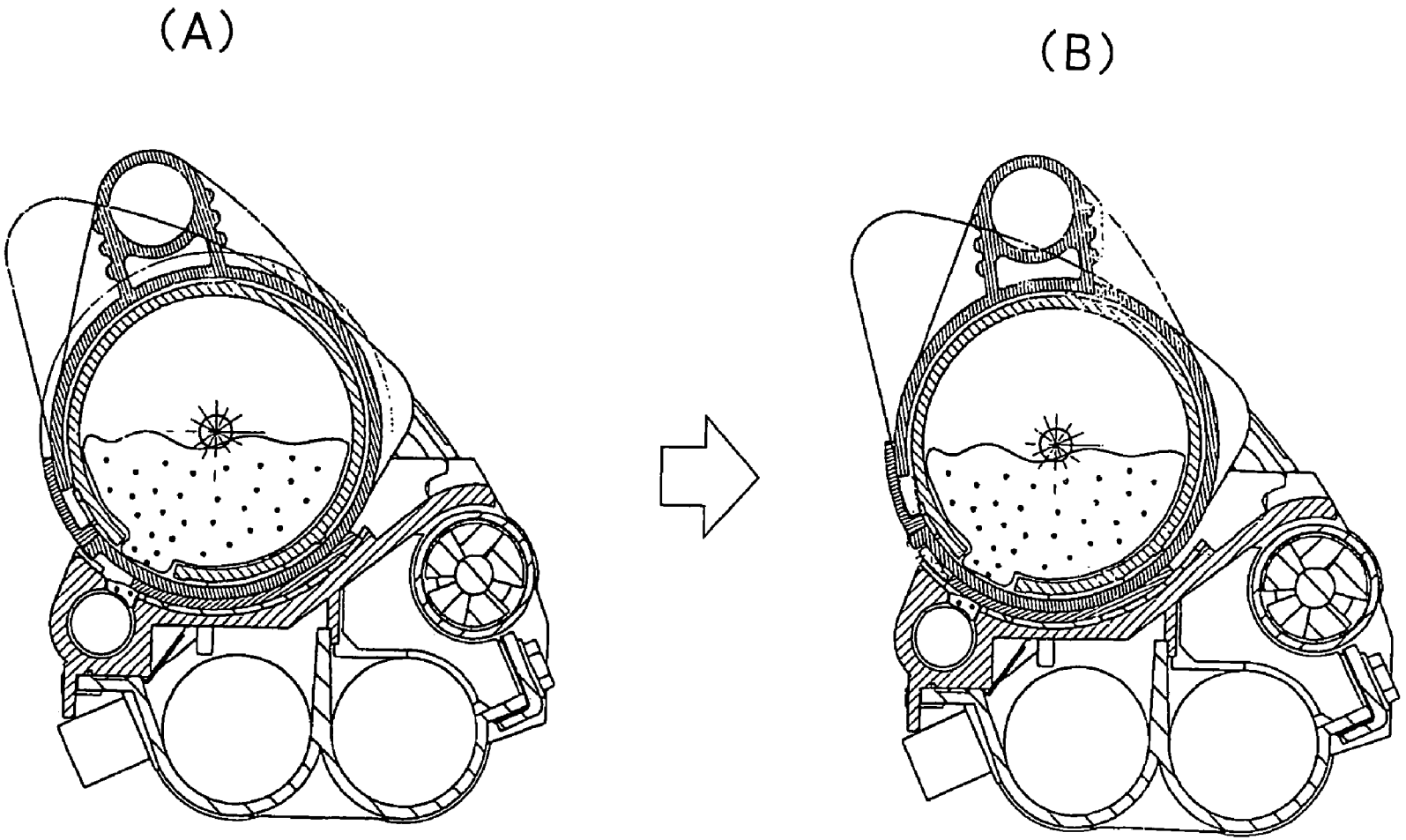
FIGS. 18(A) and 18(B) are sectional views of the developer cartridge each for showing another opening/closing operation for the shutter member thereof.
Figure 19:
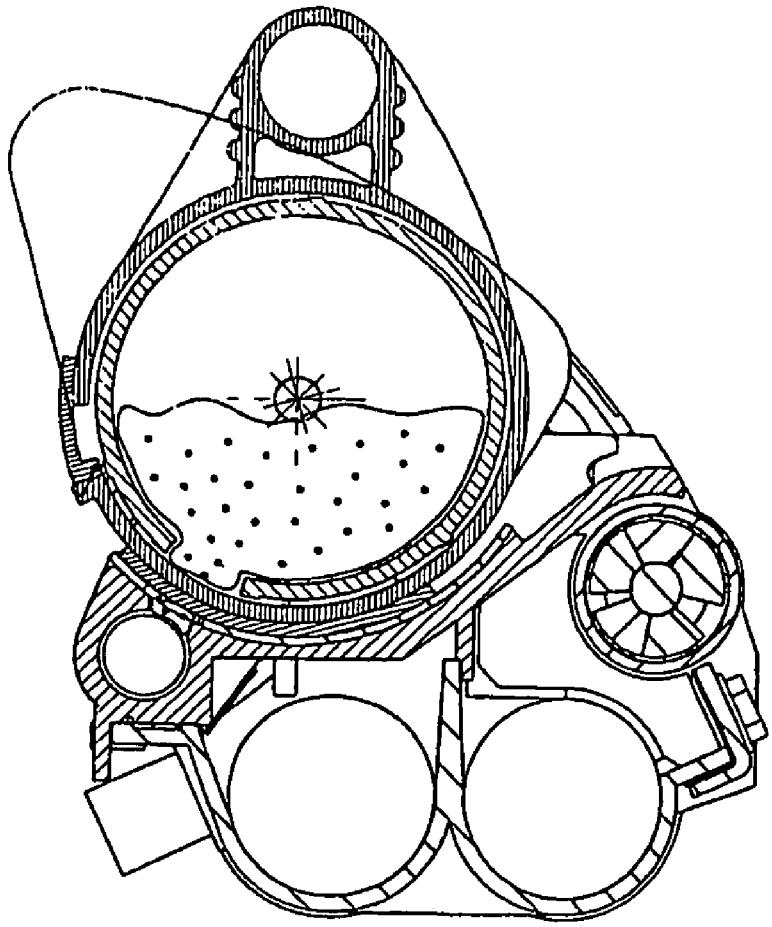
FIG. 19 is a sectional view of the developer cartridge for showing another opening/closing operation for the shutter member thereof.

As shown in FIGS. 18 and 19, in the developer cartridge 45, if the shutter member 75 is further rotated, the shutter plate 68 of the developing device main body 46 is rotated by the edge of the opening portion 76 of the shutter member 75, thereby closing the supply outlet 65 of the developer cartridge 45 completely. In that state, as shown in FIG. 13, the stopper mechanism 85 provided on the front side of the developer cartridge 45 is released. In other words, the engagement plate portion 86 that is protrusively provided in a predetermined position of the developing device main body 46 moves out of the engagement concave portion 88 of the flange 87 of the shutter member 75, and becomes movable through the guide gap 92 of the flange 87, so that the developer cartridge 45 can be removed from the developing device main body 46.

Then, a new developer cartridge 45 is slid toward the center of the developing device main body 46 from its substantially outward radial direction of the rotary developing apparatus 5 to be attached in a predetermined position of the developing device main body 46. Accordingly, the lock mechanism 80 of the developer cartridge 45 is released, making it possible for the shutter member 75 of the developer cartridge 45 to rotate counterclockwise.

Figure 17:
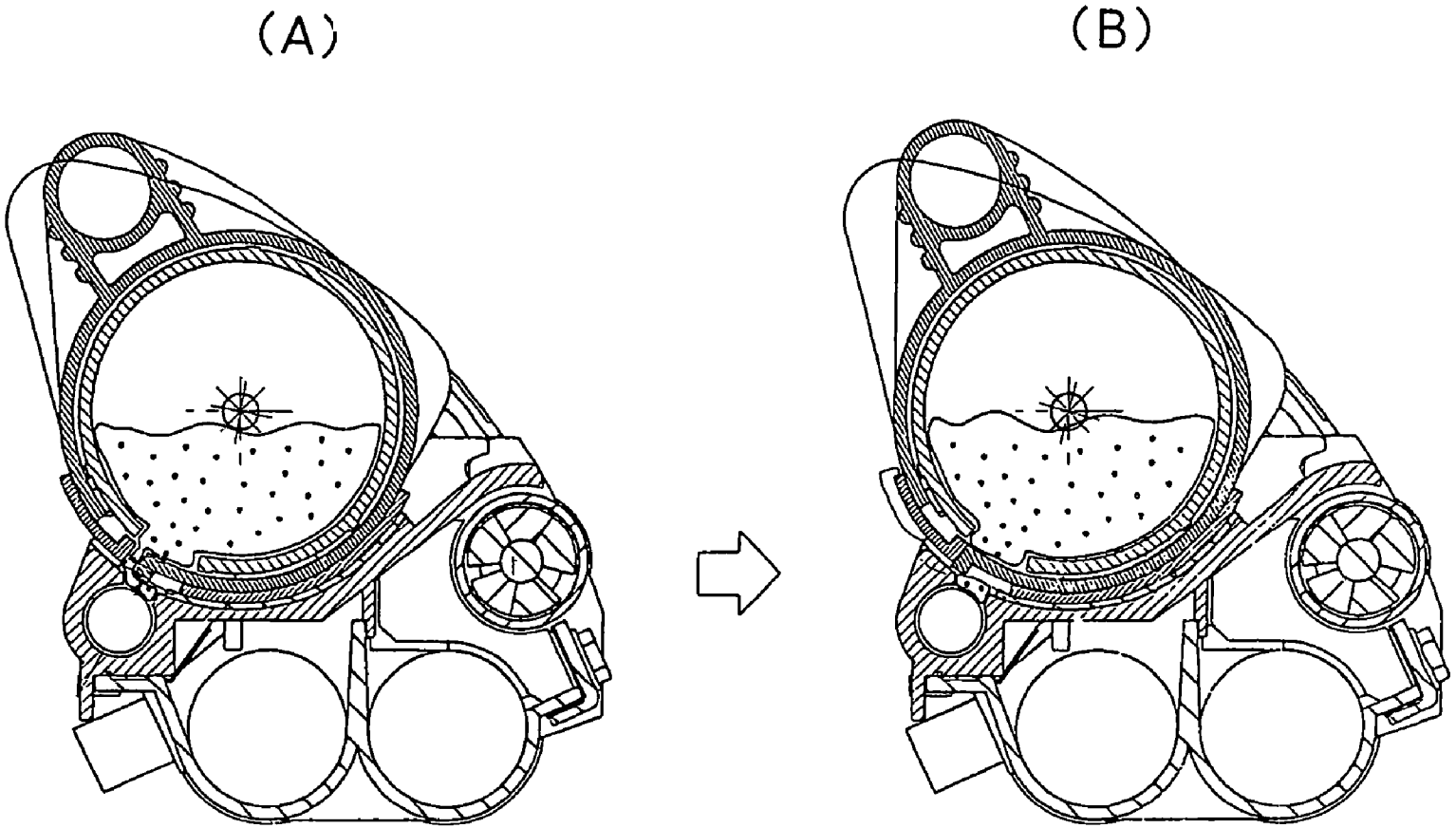
FIGS. 17(A) and 17(B) are sectional views of the developer cartridge each for showing an opening/closing operation for a shutter member thereof.

As a result, as shown in FIGS. 17 to 19, by the operation reverse to that for removing the developer cartridge 45, the developer cartridge 45 is attached to the developing device main body 46, and the supply outlet 65 and collection port 74 of the developer cartridge 45 are opened by the shutter member 75.

As described above, according to the developer cartridge 45 and the rotary developing apparatus 5 in accordance with the above embodiment, even in the case where the developing devices 5Y, 5M, 5C, and 5K are miniaturized, it is possible to set the amount of developers that can be received to be large and simplify the mechanism for opening/closing the supply outlet of the developer cartridge 45. As a result, the developer cartridge has no wasted space and thus can be miniaturized.

What is claimed is:

1. A developing apparatus, comprising:

a developer cartridge apparatus occupies approximately same length of a developing device, and including a developer receiving portion that receives a new developer, wherein:

development of an image is performed by supplying a developer from the developer cartridge; and sectional shape of the developer receiving portion in the rotation direction of a developing apparatus main body of the developer cartridge is formed into a shape that occupies a substantially entire space that is allocated to the developer cartridge to be attached.

2. A developing apparatus according to claim 1, further comprising:

the developing apparatus main body that is rotatably disposed;

plural developing devices arranged along a rotation direction of the developing apparatus main body; and a developer cartridge that is provided corresponding to each of the plural developing devices and supplies a developer containing at least toner to a corresponding one of the plural developing devices.

3. A developer cartridge which is provided corresponding to each of plural developing devices arranged along a rotational direction of a developing apparatus main body that is rotatably disposed and supplies a developer containing at least toner to a corresponding one of the plural developing devices, the developer cartridge occupies approximately same length of the developing device, and comprising a developer receiving portion that receives a new developer, wherein a sectional shape of the developer receiving portion in the rotation direction of the developing apparatus main body is formed into a shape that occupies a substantially entire space allocated to the developer cartridge to be attached.

4. A developer cartridge according to claim 3, wherein the sectional shape of the developer receiving portion is formed into a substantially triangular shape in which a corner portion located at an apex is set to have a little smaller angle and each of corner portions has a circular arc shape.

5. A developer cartridge according to claim 3, wherein the sectional shape of the developer receiving portion is formed into a substantially teardrop shape.

6. A developer cartridge according to claim 3, wherein the sectional shape of the developer receiving portion includes two lines corresponding to two side surfaces which form an acute angle therebetween.

7. A developer cartridge according to claim 3, further comprising a developer collecting portion that is connected to one end portion of the developer receiving portion in a longitudinal direction and receives a collected developer, wherein:

the developer collecting portion has a sectional shape formed into a circular shape; and an end portion of the developer receiving portion on a developer collecting portion side has a sectional shape formed into a circular shape.

8. A developer cartridge according to claim 7, further comprising an opening/closing member that is rotatably provided to a circumference of the developer collecting portion and performs at least one of simultaneous opening and simultaneous closing on a supply outlet of the developer receiving portion and a collection port of the developer collecting portion.

9. A developer cartridge according to claim 8, wherein the opening/closing member is unitarily provided with a handle for rotating the opening/closing member.

10. A developer cartridge according to claim 9, wherein the handle has a grip portion provided with a non-slip part.

11. A developer cartridge according to claim 8, further comprising a lock mechanism that prevents the opening/closing member from rotating in a direction for opening the supply outlet.

12. A developer cartridge according to claim 8, further comprising a stopper mechanism that prevents the developer cartridge from being subjected to attaching/detaching in a state where the supply outlet is left open by the opening/closing member.

13. A developer cartridge which is provided corresponding to each of plural developing devices arranged along a rotation direction of a developing apparatus main body that is rotatably disposed, and supplies a developer containing at least toner to a corresponding one of the plural developing devices, the developer cartridge occupies approximately same length of the developing device, and comprising a developer receiving portion that receives a new developer, wherein a sectional shape of the developer receiving portion in the rotation direction of the developing apparatus main body is formed into a non-circular shape that occupies a space excluding a space occupied by one of the plural developing devices from a space that is allocated to the one of the plural developing devices of the developing apparatus main body to which the developer cartridge is attached.

14. A developer cartridge according to claim 13, further comprising a developer collecting portion that is provided to one end of the developer receiving portion so as to extend in a longitudinal direction of the developer receiving portion and receives a used developer collected from the one of the plural developing devices, wherein a sectional shape of the developer collecting portion in the rotation direction of the developing apparatus main body is formed into a circular shape that is substantially inscribed in the space excluding the space occupied by the one of the plural developing devices from the space that is allocated to the one of the plural developing devices of the developing apparatus main body to which the developer cartridge is attached.

15. A developer cartridge according to claim 13, wherein the sectional shape of the developer receiving portion in the rotation direction of the developing apparatus main body is formed into a non-circular shape that substantially occupies an entirety of the space excluding the space occupied by the one of the plural developing devices from the space that is allocated to the one of the plural developing devices of the developing apparatus main body to which the developer cartridge is attached.

16. A developer cartridge according to claim 13, wherein the sectional shape of the developer receiving portion in the rotation direction of the developing apparatus main body includes two lines corresponding to a curved surface that is curved in the rotation direction of the developing apparatus main body and to a curved surface with a curvature radius smaller than a curvature radius of the curved surface that is curved in the rotation direction of the developing apparatus main body.

17. A developer cartridge according to claim 16, wherein the curved surface that is curved in the rotation direction of the developing apparatus main body has such a curvature as to be substantially inscribed in a curved surface along a circumference in a rotation direction of the developing apparatus main body.

18. A developer cartridge according to claim 16, wherein the curved surface with a small curvature radius has substantially the same rotation center as a rotation center of an agitating member that agitates a developer inside the developer cartridge.

19. A developer cartridge according to claim 16, wherein the curved surface that is curved in the rotation direction of the developing apparatus main body has substantially the same rotation center as a rotation center of the developing apparatus main body.

20. A developer cartridge according to claim 13, wherein the sectional shape of the developer receiving portion includes two lines corresponding to two side surfaces which form an acute angle therebetween.

21. A developer cartridge according to claim 13, wherein the sectional shape of the developer receiving portion is formed into a substantially teardrop shape.

22. A developer cartridge according to claim 14, further comprising:

a supply outlet that is opened in the developer collecting portion so as to communicate with the developer receiving portion and serves to supply a developer to an outside;

an opening/closing member that opens and closes the supply outlet; and a handle for gripping the developer cartridge to be attached to and detached from the developing apparatus main body, wherein the handle is unitarily formed with the opening/closing member.

23. A developer cartridge according to claim 22, wherein:

the opening/closing member is formed into such a cylindrical shape as to be inserted to rotatably fit to a circumference of the developer receiving portion; and the handle is provided to a part of a circumference of the opening/closing member so as to protrude toward its outward radial direction.

24. A developer cartridge according to claim 22, wherein the handle is configured to be received within a rotational circumference of the developing apparatus main body in a state where the developing apparatus main body is capable of rotating.

25. A developer cartridge according to claim 23, wherein the handle has a grip portion provided with a non-slip part.

26. A developer cartridge according to claim 22, further comprising a lock mechanism that prevents the opening/closing member from rotating in a direction for opening the supply outlet in a state where the developer cartridge is removed from the developing apparatus main body.

27. A developer cartridge according to claim 22, further comprising a stopper mechanism that prevents the developer cartridge from being removed from the developing apparatus main body in a state where the supply outlet is left open by the opening/closing member.

28. A developer cartridge according to claim 22, wherein the handle is configured to protrude toward an outside of the rotational circumference of the developing apparatus main body in a state where the developer cartridge can be removed from the developing apparatus main body.

29. An image forming apparatus, comprising a developing apparatus including:

a developing apparatus main body that is rotatably disposed;

plural developing devices arranged along a rotation direction of the developing apparatus main body; and a developer cartridge that is provided corresponding to each of the plural developing devices and supplies a developer containing at least toner to a corresponding one of the plural developing devices, wherein:

an image is formed by sequentially developing electrostatic latent images formed on image bearing members by the plural developing devices of the developing apparatus;

the developer cartridge that supplies the developer containing at least toner to the corresponding one of the plural developing devices includes a developer receiving portion that receives a new developer; and a sectional shape of the developer receiving portion is formed into a shape that occupies a substantially entire space that is allocated to the developer cartridge to be attached.

* * * * *